US006048046A

United States Patent [19]

Saito et al.

[11] Patent Number: 6,048,046

[45] Date of Patent: Apr. 11, 2000

[54] INK DISCHARGE DETECTING METHOD FOR AN INK JET RECORDING APPARATUS, SAID INK JET RECORDING APPARATUS AND AN IMAGE FORMING DEVICE USING SAID INK JET RECORDING APPARATUS

[75] Inventors: Atsushi Saito, Yokohama; Akio Okubo, Tokyo; Keizo Sasai, Yokohama; Yasuhiko Ikeda, Sagamihara; Shigeyuki Sugiyama, Yokohama; Mitsuo Morita, Tokyo, all of Japan

[73] Assignee: Canon Kabushiki Kaisha, Tokyo, Japan

[21] Appl. No.: 08/591,024

[22] Filed: Jan. 25, 1996

Related U.S. Application Data

[62] Division of application No. 08/031,864, Mar. 16, 1993, Pat. No. 5,508,722.

[30] Foreign Application Priority Data

| | | | |
|---|---|---|---|
| Mar. 23, 1992 | [JP] | Japan | 4-064840 |
| Jan. 26, 1993 | [JP] | Japan | 5-010995 |

[51] Int. Cl.[7] ..... B41J 2/01

[52] U.S. Cl. ..... 347/19

[58] Field of Search ..... 347/14, 17, 19, 347/6, 7, 23, 22, 29

[56] References Cited

U.S. PATENT DOCUMENTS

| | | | |
|---|---|---|---|
| 4,245,224 | 1/1981 | Isayama et al. | 347/10 |
| 4,296,418 | 10/1981 | Yamazaki et al. | 347/28 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,896,172 | 1/1990 | Nozawa et al. | 347/17 |
| 5,136,305 | 8/1992 | Ims | 347/7 |
| 5,350,929 | 9/1994 | Meyer et al. | 250/573 |
| 5,508,722 | 4/1996 | Saito et al. | 347/17 |

FOREIGN PATENT DOCUMENTS

| | | | |
|---|---|---|---|
| 0110634 | 6/1984 | European Pat. Off. . | |
| 0380056 | 8/1990 | European Pat. Off. . | |
| 0437062 | 7/1991 | European Pat. Off. . | |
| 0443832 | 8/1991 | European Pat. Off. . | |
| 3246707 | 6/1984 | Germany . | |
| 3925048 | 1/1991 | Germany . | |
| 54-56847 | 5/1979 | Japan . | |
| 58-217365 | 12/1983 | Japan . | |
| 59-12857 | 1/1984 | Japan . | |
| 59-42966 | 3/1984 | Japan | 347/6 |
| 59-123670 | 7/1984 | Japan . | |
| 59138461 | 8/1984 | Japan . | |
| 60-71260 | 4/1985 | Japan . | |
| 62-253457 | 11/1987 | Japan . | |
| 2-4521 | 1/1990 | Japan | 347/23 |
| 2187363 | 7/1990 | Japan . | |
| 4-31058 | 2/1992 | Japan . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

If one page of recording is terminated, a carriage moves to a position at which a recording head is located opposite a cap. Then, the ink is discharged through nozzles of the recording head onto temperature detecting element within the cap. Temperature change of the temperature detecting element upon contact with the ink is output from a detecting circuit, and the normal discharge of ink is detected by discharge detecting means. In this way, a decrease in the ink remaining or the detection of ink nondischarge can be securely made.

27 Claims, 18 Drawing Sheets

INK DISCHARGE DETECTING METHOD FOR AN INK JET RECORDING APPARATUS, SAID INK JET RECORDING APPARATUS AND AN IMAGE FORMING DEVICE USING SAID INK JET RECORDING APPARATUS

This application is a division of application Ser. No. 08/031,864 filed Mar. 16, 1993, now U.S. Pat. No. 5,508, 722.

BACKGROUND OF THE INVENTION

1. Field of the Invention

The present invention relates to an ink discharge detecting method for an ink jet recording apparatus, and the ink jet recording apparatus.

2. Related Background Art

Conventionally, a variety of recording apparatuses for recording onto a recording medium such as a paper or OHP sheet have been proposed, and especially, an ink jet recording apparatus which directly jets the ink from a recording head onto a recording sheet, has gained wide acceptance as a recording apparatus having the advantages of low running cost and silent recording operation.

On the other hand, the method for detecting that the amount of ink has decreased in such an ink jet recording apparatus involves optically detecting a float moving up or down within an ink tank, or detecting the variation in resistance between electrodes provided within an ink tank.

However, the above conventional methods had a drawback that since a detecting member such as a float or electrodes was necessary within the ink tank, the detecting member had to be also exchanged integrally with the cartridge to be exchanged when the amount of ink within the ink tank decreased, for example, in the case of a disposable recording head of the cartridge type in which the recording head was formed integrally with the ink tank, so that costs and waste increased.

Further, the above conventional methods involved detecting analogue variation of ink quantity which resulted from decreasing amount of ink within the ink tank, whereby if the detected result was below a preset threshold, the ink absence was detected, at which time the ink within the recording head was not completely absent in practice, with the result that the decrease in the amount of ink was detected while a slight amount of the ink was left within the ink tank.

Accordingly, there was a problem that because the waste ink unusable for the recording was produced, the running costs increased. Also, there was a problem that the ink level within the ink tank shifted up or down, along with the movement of the ink tank, bringing about malfunctions.

SUMMARY OF THE INVENTION

The present invention is devised to resolve the above-mentioned problems of the conventional art, and its object is to provide an ink jet recording apparatus and an ink discharge detecting method in which the decrease in ink remain or undischarge of ink can be securely detected with the amount of waste ink unusable for the recording reduced.

Also, it is another object of the invention to provide an ink jet recording apparatus for recording using a recording head which discharges heated ink onto a recording medium through discharge ports, characterized by comprising temperature detecting means, which is contactable with the ink discharged through said discharge ports, for detecting temperature change arising upon contact with said ink, positioning means for positioning said recording head and said temperature detecting means at relatively opposed locations so that the ink discharged through said discharge ports make contact with said temperature detecting means, and discharge detecting means for detecting discharge or undischarge of ink based on a detecting result of said temperature detecting means.

Also, it is another object of the invention to provide an ink jet recording apparatus for recording using a recording head having a plurality of nozzles which discharges the ink, characterized by comprising discharge detecting means for detecting the presence or absence of ink discharge from said recording head, varying means for varying the number of discharged ink droplets per unit time, and a control circuit for controlling the number of discharged droplets per unit time in making discharge detection by said discharge detecting means to be different from that during the recording, using said varying means.

Also, it is another object of the invention to provide an ink jet recording apparatus for recording using a recording head having a plurality of nozzles which discharges the ink, characterized by comprising discharge detecting means for detecting the presence or absence of ink discharge from said recording head, varying means for varying the volume of discharged ink droplets per unit time, and a control circuit for controlling the volume of discharged droplets per unit time in making discharge detection by said discharge detecting means to be different from that during the recording, using said varying means.

Also, it is another object of the invention to provide an ink jet recording apparatus for recording using a recording head having a plurality of nozzles which discharges the ink, characterized by comprising discharge detecting means for detecting the presence or absence of ink discharge from said recording head, and selecting means for selecting the discharge state from each discharge port of said recording head when discharge detection is made by said discharge detecting means, said recording head provided with a discharge port array having a plurality of discharge ports arranged.

Also, it is another object of the invention to provide an ink jet recording apparatus for recording using a recording head having a plurality of nozzles which discharges the ink, characterized by comprising discharge detecting means for detecting the presence or absence of ink discharge from said recording head, input means for indicating the start of discharge detection, and a control device for controlling discharge detection with said discharge detecting means to be performed periodically or when input is made into said input means.

Also, it is another object of the invention to provide an ink discharge detecting method of an ink jet recording apparatus for recording using a recording head which discharges the ink onto a recording medium through discharge ports, characterized by including a process of discharging the ink from said discharge ports to make contact with an objective, a process of detecting the physical change produced in said objective by the discharged ink, and a process of detecting the discharge or undischarge of ink based on a detected result of said physical change.

Also, it is another object of the invention to provide an ink discharge detecting method of an ink jet recording apparatus for recording using a recording head in which the discharge direction of the ink discharged through a plurality of discharge ports onto a recording medium may lie in a horizontal direction or oblique to the horizontal direction, characterized by including a process of discharging the ink from said discharge ports to make contact with an objective, a process of detecting the physical change produced in said objective by the discharged ink, and a process of detecting the discharge or undischarge of ink based on a detected result of said physical change, wherein when discharge detection is made, the ink is discharged selectively from the discharge ports located upward in a vertical direction, among discharge ports of said recording head.

Also, it is another object of the invention to provide an ink remain detecting method of an ink jet recording apparatus for recording using a recording head which discharges the ink through discharge ports onto a recording medium, characterized by including a process of discharging the ink from said discharge ports to make contact with an objective, a process of detecting the physical change produced in said objective by the discharged ink, and a process of detecting the ink remain based on a detected result of said physical change.

Also, it is another object of the invention to provide an ink discharge detecting method performed with an ink jet recording apparatus having a recording head having a plurality of nozzles which discharges the ink, and discharge detecting means for detecting the presence or absence of ink discharge from said recording head, characterized in that the number of discharged ink droplets per unit time is made variable, so that the number of discharged droplets per unit time in making discharge detection may be different from that during the recording.

Also, it is another object of the invention to provide an ink discharge detecting method performed with an ink jet recording apparatus having a recording head having a plurality of nozzles which discharges the ink, and discharge detecting means for detecting the presence or absence of ink discharge from said recording head, characterized in that the volume of discharged ink droplets per unit time is made variable, so that the volume of discharged droplets per unit time in making discharge detection may be different from that during the recording.

With the above constitution, if one page of recording is terminated, the carriage is moved to a position at which the recording head is located opposite a cap. Then, the ink is discharged through the nozzles of the recording head onto a temperature detecting element within the cap. Temperature change of the temperature detecting element upon contact with the ink is output from a detecting circuit, and the normal discharge of ink is detected by discharge detecting means.

DETAILED DESCRIPTION OF THE PREFERRED EMBODIMENTS

The preferred embodiments of the present invention will be described below with reference to the drawings.

Embodiment 1-1

Figure 1:
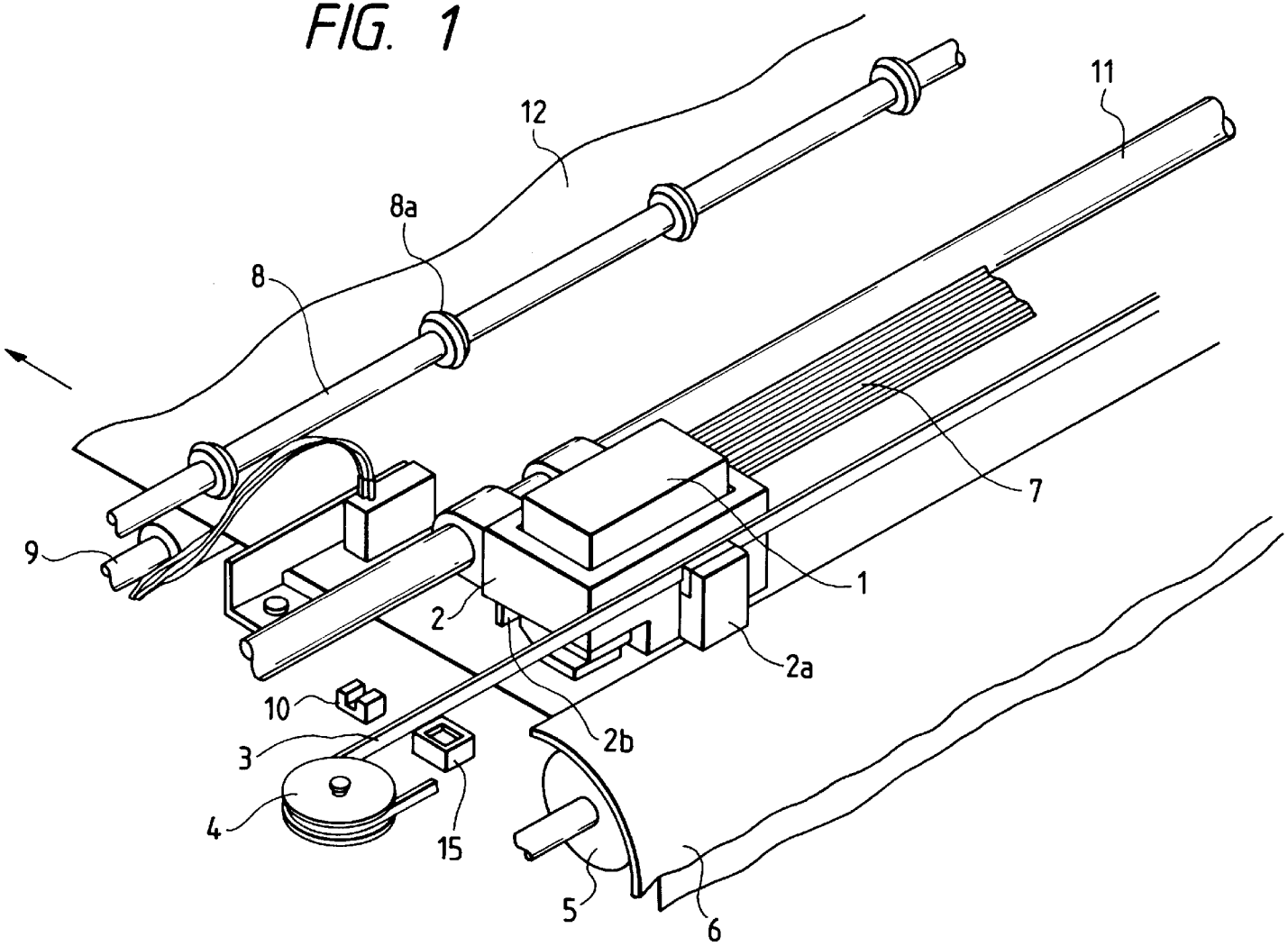
FIG. 1 is a perspective view of a recording unit in an ink jet recording apparatus.

FIG. 1 is a view showing an ink jet recording apparatus to which the present invention is applied. In FIG. 1, 1 is a recording head, or in this embodiment, an ink jet recording head of the cartridge type in which an ink tank is contained therein and the whole recording head is exchanged for a new one when the ink becomes absent. 2 is a carriage for reciprocating the recording head 1 in a direction orthogonal to a conveying direction (sub-scan direction) of recording sheet 12 as indicated by the arrow, i.e., in a main scan direction, while carrying the recording head 1 at good precision, in which the carriage is slidably held by a guide rod 11 and an abutting portion 2*a*. Reciprocating of the carriage 2 is performed by a pulley 4 driven by a motor not shown, and a timing belt 3, in which a print signal and the power to be given to the recording head 1 is supplied via a connector contained in the carriage 2 through a flexible cable 7 from an electric circuit in a main device.

15 is a cap serving as ink receiving means, which is placed corresponding to a stand-by position (home position) of the carriage 2, and moved up or down as required to make close contact with the recording head 1 to cover a nozzle unit, thereby preventing the evaporation of ink or contamination of dirt.

In this embodiment, to position the-recording head 1 and the cap 15 at relatively opposed locations, a carriage home sensor 10 provided on the main device of recording apparatus and a light shielding plate 2*a* provided on the carriage 2 are used. The carriage home sensor 10 is composed of a photo-interrupter of the transmission or reflection type, which detects that when the carriage 2 is moved to the stand-by position, light transmitted from a portion of the carriage home sensor 10 is interrupted from passing therethrough by the light shielding plate 2*a*, or the recording head 1 and the cap 15 are positioned at relatively opposed locations, using reflected light.

Recording sheet 12 is supplied from the lower side upwardly in the figure, and bent to a horizontal direction by a sheet supply roller 5 and a paper guide 6 to be conveyed in a direction (sub-scan direction) as indicated by the arrow. The sheet supply roller 5 and a sheet exhaust roller 9 are driven by respective drive systems, not shown, to convey the recording sheet 12 in the sub-scan direction at high precision, in cooperation with the carriage 2 which is reciprocated, as required. 8 is a so-called spur shaft made of a water repellent material, and having spurs 8*a* spaced away at a predetermined interval so that they make contact with the recording surface of recording sheet 12 only at their circumferential blade-like portions, whereby even if they make contact with unfixed ink on the recording sheet immediately after the printing, the recording sheet 12 can be guided and conveyed without exerting adverse effects on the image.

The recording head 1 for use in this embodiment is a recording head of the ink jet system with a resolution of 360DPI, and having 64 nozzles, in which the ink can be discharged through discharge ports at the top end of nozzles by the use of the pressure of film boiling arising in the ink due to heating by electricity-heat converters provided within the nozzles.

Next, a discharge principle of recording head for use with the ink jet recording apparatus in this embodiment as recording means of the present invention will be described below. A recording head unit to be applied to the ink jet recording apparatus typically comprises minute liquid discharge ports (orifices), liquid channels, energy exerting portions each provided on a part of each liquid channel, and energy generating means for generating liquid droplet forming energy to be applied to the liquid residing in said energy exerting portions, and is exchangeable.

Examples of energy generating means for generating such energy may include using electromechanical transducer such as piezo element, directing electromagnetic wave such as a laser to the liquid to be heated by absorption to discharge fine liquid droplets under the action of the heating, or heating the liquid by the use of electricity-heat converters to discharge the liquid. Among them, a recording head unit for use with the ink jet recording system of discharging the liquid by heat energy allows the recording to be made at high resolutions because liquid discharge ports (orifices) for discharging liquid droplets to form flying liquid droplets for recording can be arranged at high densities.

Also, the recording head unit using electricity-heat converters as energy generating means makes it possible to provide an ink jet recording head which is easy to fabricate in multi-nozzle form and allows for high density packaging, with excellent mass productivity and low manufacturing costs, because the whole recording head can be easily made in compact size, and by fully utilizing many merits of the IC technology or micro process technology which has achieved remarkable technical advancements with improved reliability in the recent semiconductor fields, the longer and planar (two dimensional) construction can be easily accomplished.

An ink jet recording head unit fabricated through a semiconductor fabrication process by using electricity-heat converters as energy generating means is typically provided with liquid channels corresponding to ink discharge ports, and electricity-heat converters as means for applying heat energy to the liquid filling the liquid channels to discharge the ink through corresponding ink discharge ports to form flying liquid droplets, wherein the liquid is supplied from a common liquid chamber to each liquid channel. As to the fabrication method for the ink discharge unit, there is an application for a method in which on a first substrate are laminated sequentially a solid layer for forming at least liquid channels, an active energy line curable material layer for use to form at least walls of liquid channels, and a second substrate, then a mask is laminated on the second substrate, active energy line is directed from upward of said mask toward at least the walls of liquid channels on the active energy line curable material layer to cure them as the constitutional portion, and then uncured portions of the solid layer and the active energy line curable material layer are removed from between two substrates to form at least liquid channels (see Japanese Laid-open Patent Application No. 62-253457).

Figure 2:
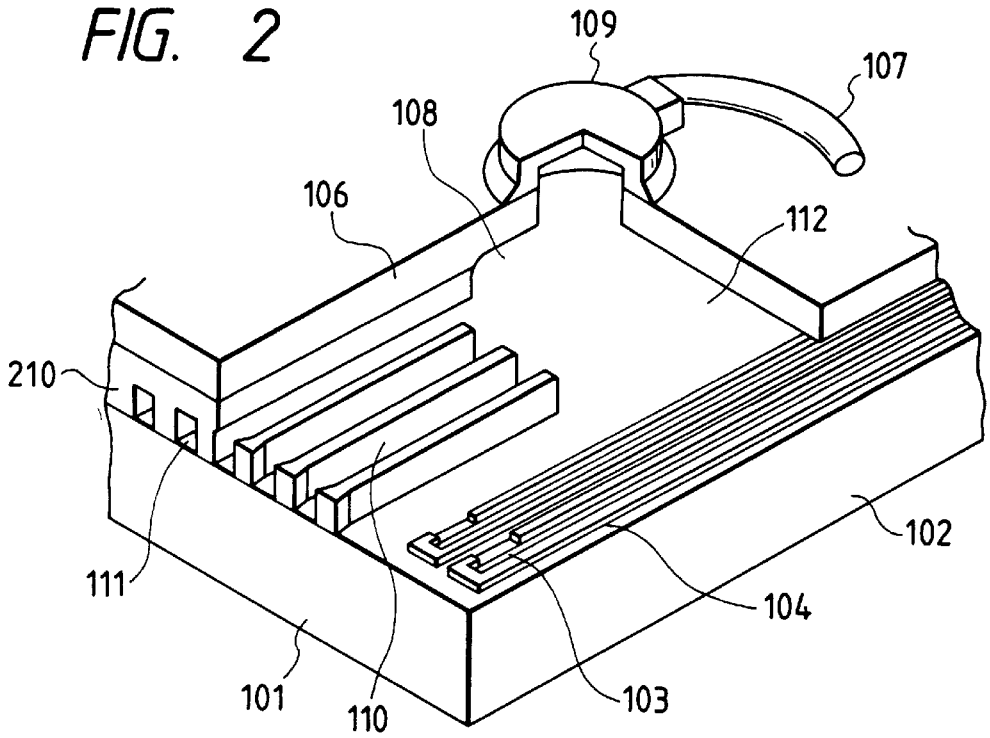
FIG. 2 is a perspective view showing the constitution of a recording head.

FIG. 2 shows a schematic constitution of the ink jet recording head unit. The recording head unit 101 is constituted of an active energy line curable material layer 210 which has been cured, having electricity-heat converters 103, electrodes 104 and liquid channels 110 formed as the film on a substrate 102 which is a first substrate, through a semiconductor fabrication process such as etching vapor deposition and sputtering, and a ceiling plate 106. In such recording head unit 101, recording liquid 112 is supplied from a liquid reservoir through a liquid supply tube 107 to a common liquid chamber 108.

109 is a connector for liquid supply tube. Recording liquid 112 in the common liquid chamber 108 is supplied into liquid channels 110 owing to capillary phenomenon, and retained stably with meniscuses formed on the ink discharge ports 111 at the top end of liquid channels. Thus, if electricity-heat converters 103 are energized, the liquid on the plane of electricity-heat converters is heated, giving rise to foaming phenomenon due to film boiling to discharge liquid droplets through ink discharge ports 111 by growth of bubbles. With the above constitution, a multi-nozzle ink jet recording head unit can be fabricated having a high density arrangement of liquid channels with a discharge port density of 400 dots/inch.

Accordingly, the temperature of discharged ink droplets becomes greatly higher than room temperature owing to heating by electricity-heat converters, the temperature change upon contact with ink droplets is detected by temperature detecting means, and the detected temperature is compared with room temperature, whereby the normal or abnormal discharge, or the presence or absence of ink within the ink tank can be examined. In this embodiment a temperature detecting element 16 is provided within the cap 15, and with the recording head 1 and the temperature detecting element 16 positioned at relatively opposed locations, the ink is discharged toward the temperature detecting element 16, and the presence or absence of ink discharge can be judged by monitoring the output of the temperature detecting element 16.

Herein, the temperature detecting element 16 may include, but not limited to, those of detecting the temperature change as a physical quantity, and detecting the temperature change as a chemical change of substance; for example, the temperature change caused by the contact with the ink is detected as a change in the current or voltage on the basis of the change in the resistance value of a resistor.

Figure 3:
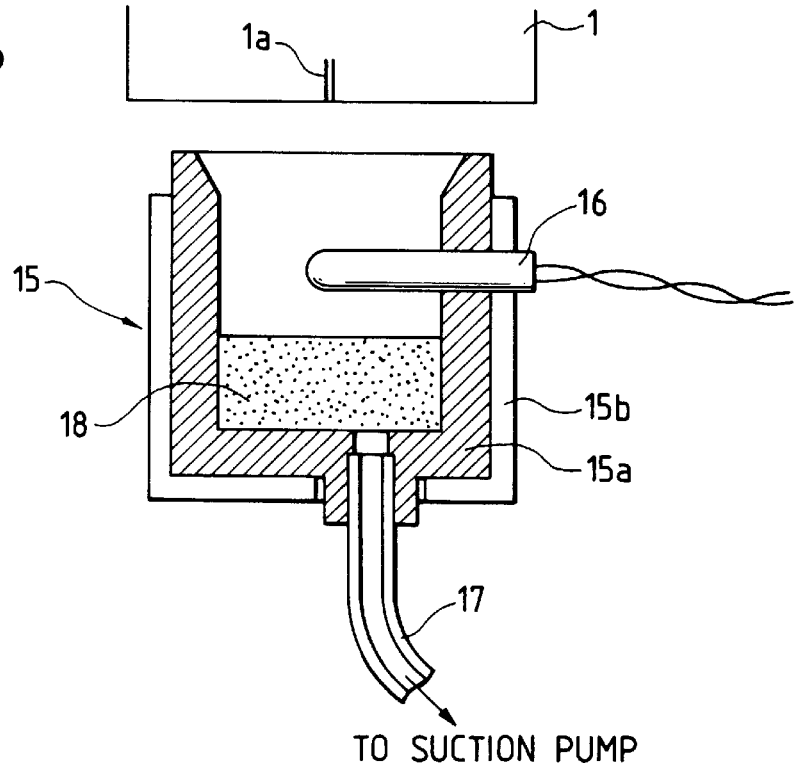
FIG. 3 is a cross-sectional view showing the structure of a cap unit in the ink jet recording apparatus.
Figure 15:
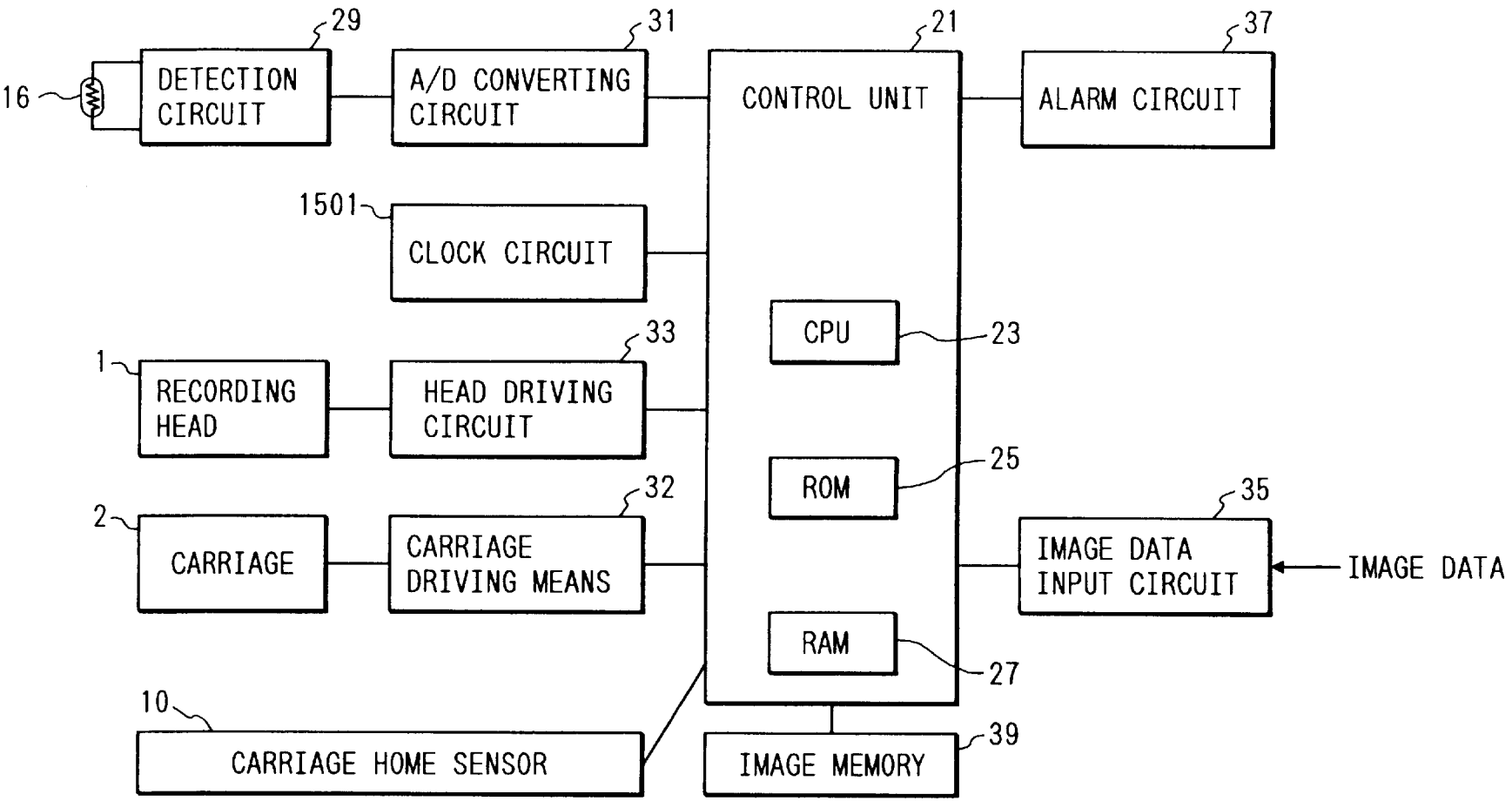
FIG. 15 is a diagram showing the configuration of a first embodiment for changing the amount of discharged droplets.

FIG. 3 is a cross-sectional view showing the details of the cap 15. In FIG. 15, 15*a* is a cap main body formed of an elastic material such as a rubber, which is held by a cap support 15*b* and pressed against the surface of recording head 1 which is placed opposed to the cap, thereby sealingly enclosing the nozzles la of the recording head 1 to prevent the nozzles 1*a* from clogging due to evaporation of ink. On the other hand, when the clogging occurs in the nozzles 1*a*, the pressure within the cap 15 is caused to decrease by activating a suction pump not shown connected to one end of a suction tube 17, so that the ink is discharged through the nozzles 1*a* of the recording head 1, thereby removing the clogging to recover the recording head 1.

18 is an ink absorbing member, which is configured to absorb the ink discharged from the discharge ports 1*a*, and have the feature of retaining the interior of cap 15 in a highly humid state by absorbing the ink, thereby preventing the nozzles 1*a* from drying and clogging.

16 is a temperature detecting element for detecting the absence of ink, which is a small thermistor in this embodiment. The temperature detecting element 16 is placed at a position substantially opposite the nozzles 1*a*, when the recording head 1 is at a stand-by position, so that if the ink is discharged from the discharge ports 1*a* of the recording head 1, ink droplets will impinge correctly on the outer face of the temperature detecting element 16, whereby it is possible to detect the presence or absence of ink discharge by detecting the presence or absence of temperature change.

Figure 4:
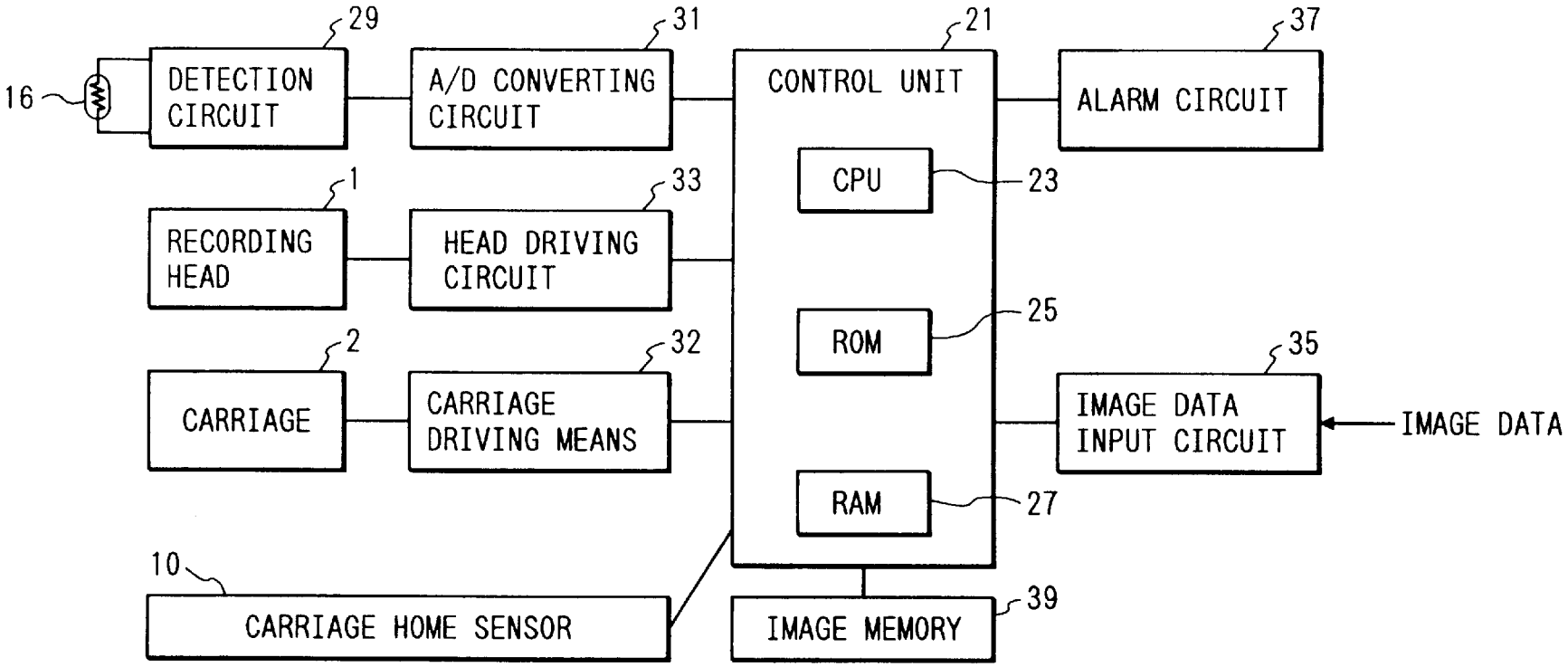
FIG. 4 is a block diagram showing a constitutional example of a control system in the ink jet recording apparatus.

FIG. 4 is a block diagram showing a schematic configuration of a main part of the recording apparatus in this embodiment. In FIG. 4, 21 is a control unit for controlling the whole of the recording apparatus, comprising a CPU 23 such as a microprocessor, a ROM 25 storing a control program for the CPU 23 as shown in flowchart of FIG. 5, and various data, and a RAM 27 useful as the work area for the CPU 23 and for temporarily storing various data.

16 is the temperature detecting element as previously described, 29 is a detection circuit connected to the temperature detecting element 16, 31 is an A/D converting circuit for converting an analog signal output from the detection circuit 29 into digital signal to be sent to a control unit 21, 33 is a head driving circuit for driving the recording head 1 in accordance with an instruction of the control unit 21, 35 is an image data input circuit for inputting image data sent from the host into the control unit 21, 37 is an alarm circuit for making an alarm for the occurrence of ink undischarge or ink absence, based on a signal sent out from the control unit 21, which detects the ink nondischarge or ink absence based on the output from the temperature detecting element 16, and 39 is an image memory for once storing print data of one page. Carriage driving means 32 for driving the carriage 2 is connected to the control unit 21.

Figure 5:
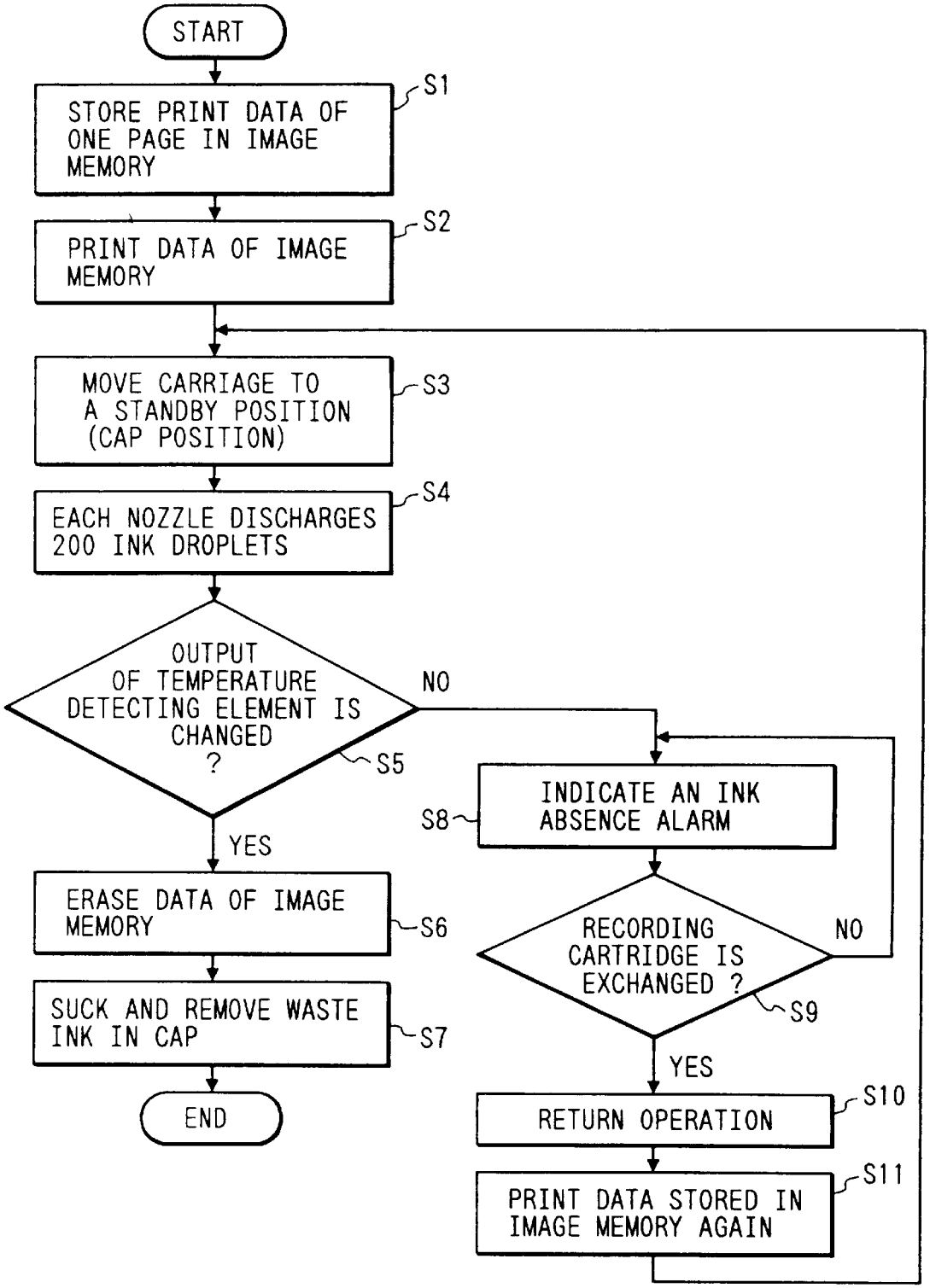
FIG. 5 is a flowchart showing the sequence of detecting the presence or absence of ink discharge.

FIG. 5 is a flowchart showing a control processing with the control unit 21. A detection sequence for ink discharge will be described with reference to the flowchart of FIG. 5. If a print start signal is received, the print data of one page sent is once stored in the image memory 39 (step S1). Then, data is printed by the recording head 1 based on data of the image memory 39 (step S2). If recording of one page is terminated, the carriage 2 is moved by the carriage driving means 32 under the control of the unit 21 to a stand-by position at which the recording head 1 is placed opposite the cap 15 (step S3), wherein whether or not the carriage 2 has moved to the stand-by position can be detected by the carriage home sensor 10.

In a state where the cap 15 is separated about 1 mm from the nozzle face, each nozzle of the recording head discharges 200 ink droplets toward the temperature detecting element 16 (step S4). The temperature of discharged droplets is from about 50 to 60° C., which is above room temperature, whereby a signal from the temperature detecting element 16 is input into the detection circuit 29 consisting of a bridge circuit and an amplifier circuit as shown in FIG. 6.

Figure 6:
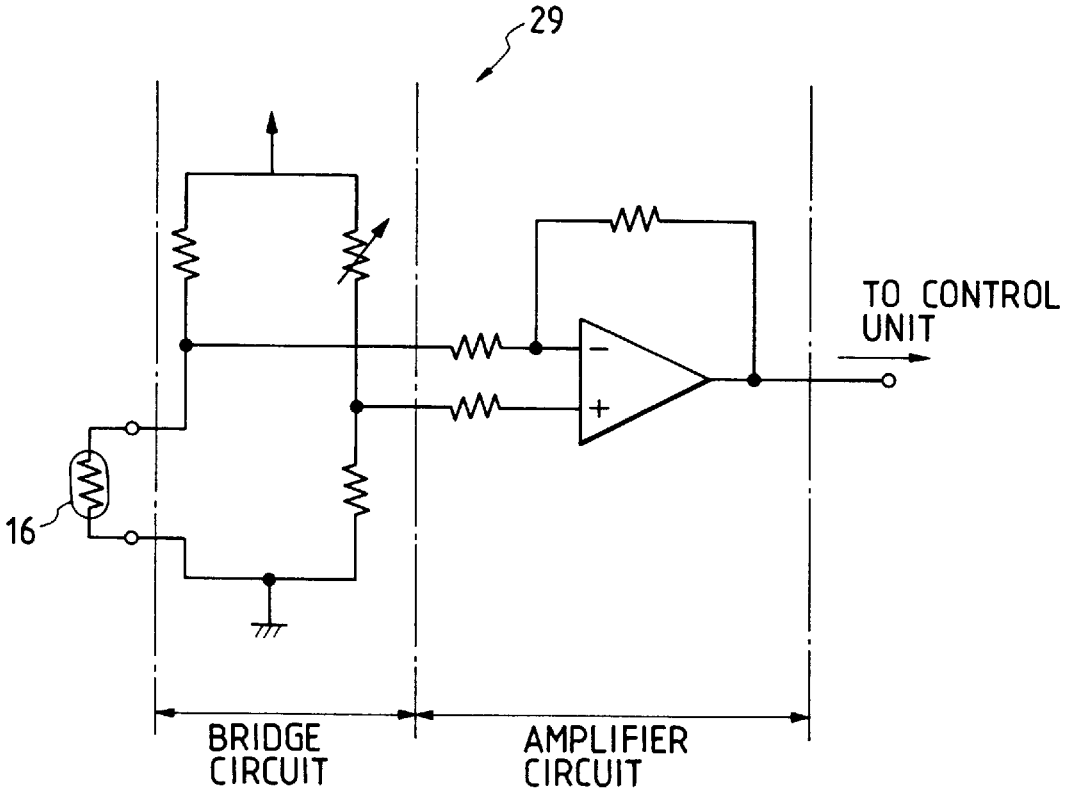
FIG. 6 is a circuit diagram showing a constitutional example of a detection circuit.

The detection circuit 29 as shown in FIG. 6 is constituted of the bridge circuit for converting the change in resistance of the temperature detecting element 16 with respect to temperature change into the voltage change, and the amplifier circuit for amplifying the voltage change thus obtained. By monitoring the voltage value output from the amplifier circuit, the temperature change of the temperature detecting element 16 can be detected. The voltage value output from the detection circuit 29 is converted from analog to digital form by the A/D converting circuit 31, and then input into the control unit 21.

The control unit 21 compares the input voltage value with a predetermined threshold (a voltage value corresponding to a temperature above the highest ambient temperature allowable with the recording apparatus and below the temperature of ink droplets, for example, 40° C.), whereby if its value is greater than the threshold, the control unit 21 judges that the output of temperature detecting element 16 has changed (Yes at step S5), and that the ink has been discharged, that is, there is some ink remaining, so that its page has been completely printed, and erases data of the image memory 39 (step S6). And to prevent discharged ink from depositing within the cap, the ink collected within the cap 15 is sucked as waste ink via a suction tube 17 by a suction pump, not shown, so as to completely remove waste ink from within the cap 15 (step S7).

On the other hand, if the voltage value output from the detection circuit 29 and input into the control unit 21 is equal to or less than the threshold, the control unit 21 judges that no output of the temperature detecting element 16 has changed (No at step S5), and that no ink is discharged, that is, there is no ink remaining. And it issues an alarm signal indicating the ink absence to the alarm circuit 37, and displays an ink absence alarm (step S8), prompting the user to exchange the recording cartridge, wherein since its page has not been completely printed as the ink is used up in the course of the recording, print data is left stored in the image memory 39.

Then, when the recording cartridge is exchanged by the user who has recognized the alarm signal (Yes at step S9), the return operation including an initial filling operation of filling new liquid channels for ink supply with the ink is performed (step S10). And data of one page is again printed from the top portion of the page, based on data stored in the image memory 39 (step S11), and then the procedure returns to step S3 to execute the operation following the step S3. In this way, the ink absence detection sequence is executed.

While in the first embodiment the temperature detecting element 16 is provided within the cap 15, it will be understood that the temperature detecting element 16 is not necessarily provided within the cap 15, and an ink absence detection unit may be separately disposed at a predetermined site on a main scan passage of the carriage and provided with the temperature detecting element 16 and a waste ink withdrawing means to enable ink discharge from the recording head. For example, in a color printer with a plurality of recording heads, it is common to have a cap as ink receiving means individually for each ink color to avoid the mixing of ink colors, and if the temperature detecting element is provided within each cap, temperature detecting elements corresponding to the number of recording heads are required, but it will be understood that if as previously described, the ink absence detection unit is provided separately, and each color ink is discharged in sequence from each recording head by moving the carriage to respective position, it is only necessary to provide a single temperature detecting element.

Since the embodiment 1-1 uses a small spherical thermistor as the temperature detecting element, which forms a spot-like temperature measuring portion, for a recording head of large print width and having a discharge port array of more nozzles, the nozzles may be only partially monitored, resulting in a risk of false detection. Accordingly, to cope with such recording head of large print width and having a discharge port array of more nozzles, the temperature measuring portion of the temperature detecting means is of a shape in which it is placed opposite the discharge ports of the discharge port array, when the recording head and the temperature detecting means are positioned at relatively opposed locations, and specifically, if the temperature detecting means is linear or planar, more reliable temperature detection will be made.

Figure 7:
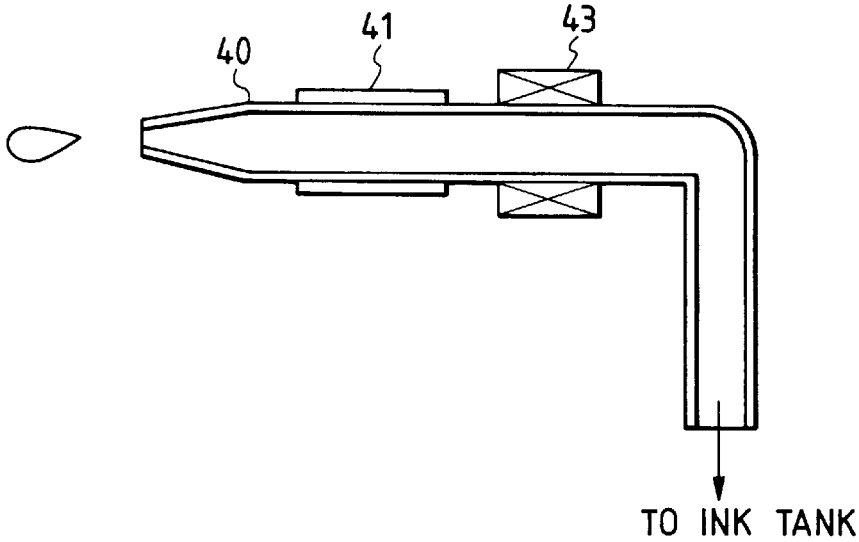
FIG. 7 is a cross-sectional view showing an example of a recording head using a piezo-electric element.

Further, the present invention is not limited to recording apparatuses of the ink jet recording system in which the ink is discharged by the use of heat energy generated by electricity-heat converters provided within nozzles, as shown in the embodiment 1-1. FIG. 7 is a cross-sectional view of an ink jet recording head using a piezo-electric (piezo) element 41 which is electricity-heat converter, instead of electromechanical transducers for use with the ink discharge in the embodiment 1-1. This is an ink jet recording system in which piezo-electric element 41 is placed on the outer surface of a nozzle tube 40, and is caused to deform by an electrical signal issued to this piezo-electric element 41, so that an ink droplet is discharged due to the change in the volume of ink chamber within the nozzle tube, but it should be noted that in this ink jet recording system, it is also possible to detect ink discharge as in the embodiment 1-1 by providing heating means 43 for heating the ink up to an appropriate temperature in the neighborhood of a nozzle to raise the temperature of flying ink droplets above room temperature. It goes without saying, in this case, that the temperature of ink droplets is controlled to be above a predetermined threshold temperature.

The heating method with heating means 43 may include those of heating the ink through the wall of nozzle tube by winding a narrow nichrome wire around the nozzle tube 40, and directly heating the ink by boring the wall face of nozzle tube and embedding a small heat generating element electrically insulated.

As above described, the recording apparatus according to the present invention allows the presence or absence of ink discharge to be detected, and therefore allows the ink nondischarge caused by some reason to be detected. If there occurs an unexpected failure, such as nondischarge owing to fixing of ink within nozzles or malfunction of electric circuit of the recording head not to permit application of discharge signal, the occurrence of such failure can be detected.

However, the recording apparatus according to the present invention makes it possible to detect ink nondischarge, the ink nondischarge can be considered as the decrease in the ink remain quantity within the ink tank.

Embodiment 1-2

Figure 8:
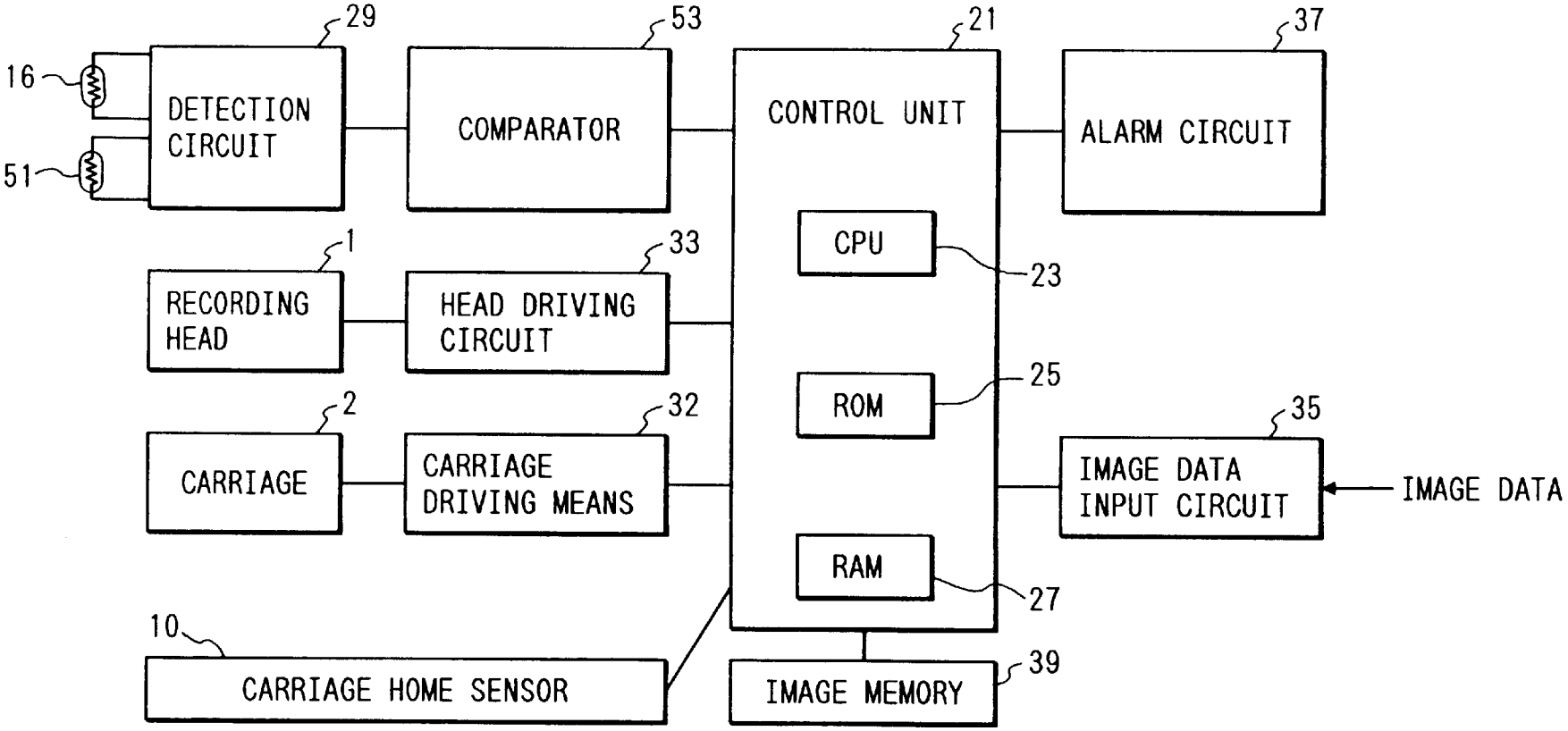
FIG. 8 is a block diagram showing a constitutional example of a control system in the ink jet recording apparatus according to another embodiment.

FIG. 8 is a block diagram showing the schematic configuration of a recording apparatus in embodiment 1-2. In FIG. 8, 51 is an ambient temperature detecting element for detecting the ambient temperature of the recording apparatus to be used, wherein this detecting element is composed of the same element as the temperature detecting element 16, and provided outside of a cap 15, as well as being connected to a detection circuit 29.

Figure 9:
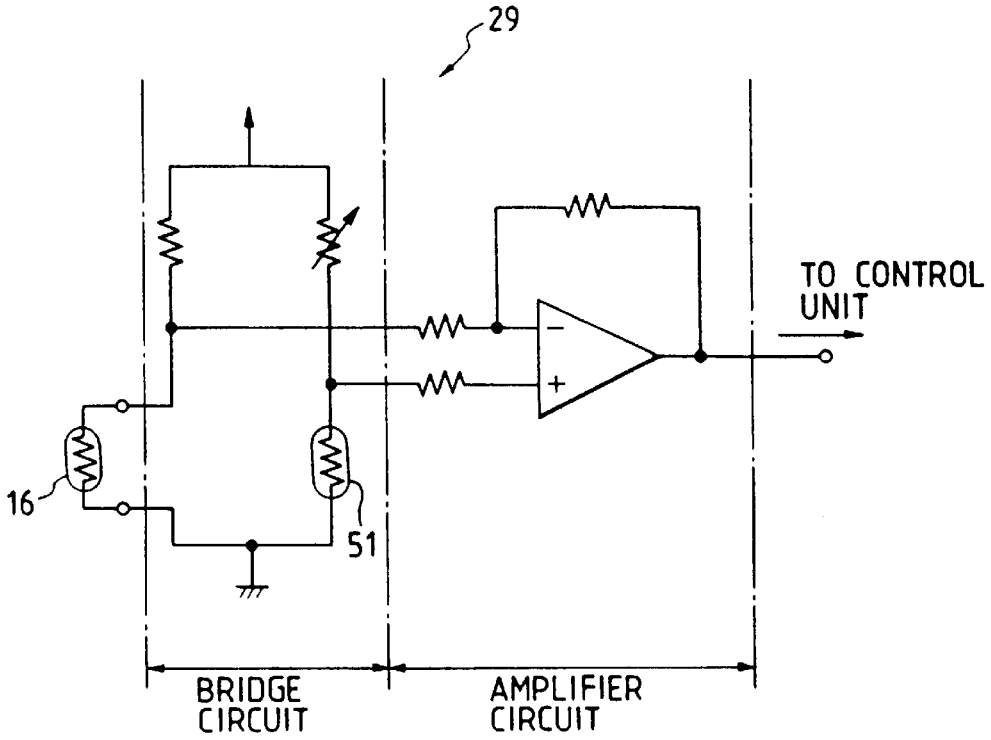
FIG. 9 is a circuit diagram showing a constitutional example of a detection circuit according to another embodiment.

FIG. 9 is a circuit diagram showing the detection circuit 29, consisting of a bridge circuit using a temperature detecting element 16 and an ambient temperature detecting element 51 for outputting the voltage proportional to the difference between resistance values of both elements, that is, the difference between both temperatures, and an amplifier circuit for amplifying the voltage thus obtained. By monitoring the voltage value output from this amplifier circuit, the temperature change of the temperature detecting element 16 relative to the ambient temperature can be detected.

Figure 10:
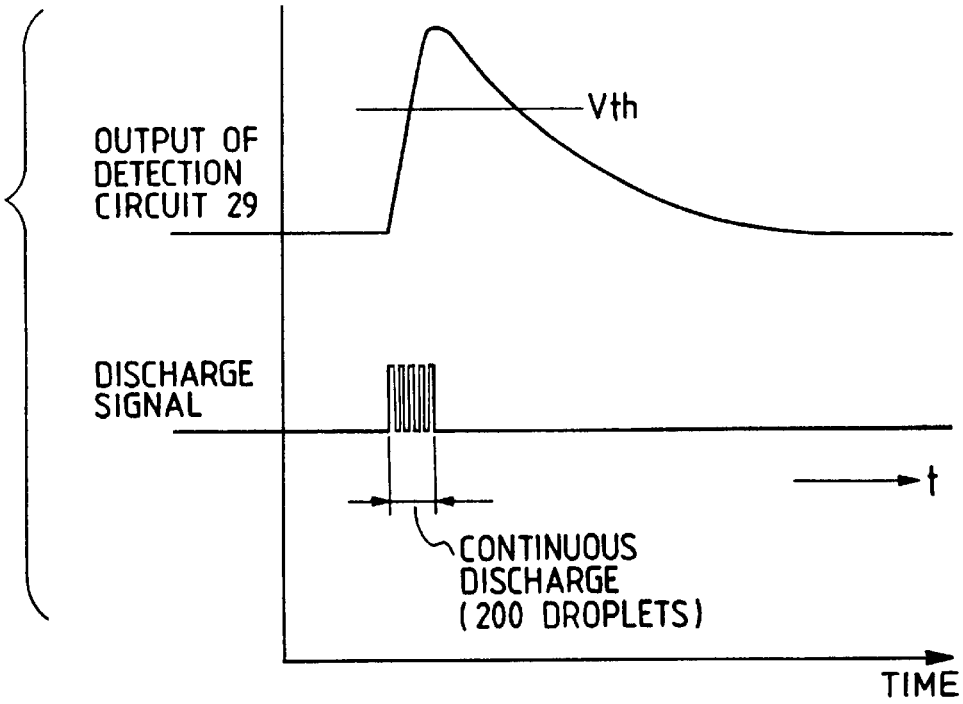
FIG. 10 is a chart showing the output waveform from the detection circuit.

53 is a comparator which outputs a signal "1" when the output from the detection circuit 29 is above a predetermined threshold, and a signal "0" when at or below the predetermined threshold, which signal is then sent to a control unit 21. FIG. 10 shows the relation between the output waveform from the detection circuit 29 and the discharge signal to the nozzles of recording head, with the time indicated in the axis of abscissas and the output voltage value from the detection circuit 29 indicated in the axis of ordinates of output waveform. In the figure, the straight line as indicated by Vth shows the threshold level.

Since other configuration of FIG. 9 is the same as in the embodiment 1-1, the explanation thereof is omitted. The detection sequence of ink discharge is the same as the control procedure as shown in the flowchart of FIG. 5 in the embodiment 1-1. Note that the judgment at step S5 is made by checking to determine whether or not the output voltage value corresponding to the difference between temperatures of the temperature detecting element 16 and the ambient temperature detecting element 51 exceeds a predetermined threshold.

According to the embodiment 1-2, when the ambient temperature decreases, its difference from the temperature of temperature detecting element 16 increases, whereby there is the effect of being less affected by instantaneous temperature changes caused by electrical noise of recording apparatus or air currents.

Note that in the embodiment 1-2, when discharging the ink through all the discharge ports at step S4, it is preferable to discharge the ink toward the temperature detecting element 16 while the carriage member 2 is moved 1 mm, that is, the recording head 1 is moved 1 mm in a main scan direction. Herein, the reason of discharging the ink while the carriage 2 is moved 1 mm is to prevent the ink from not hitting the temperature detecting element 16 due to displaced impinging position of ink droplets, wherein the recording head 1 is moved along with the movement of the carriage member 2, and flying ink droplets may also be moved about 1 mm within an opening portion of the cap 15, resulting in a higher probability of impingement upon the temperature detecting element 16, and thereby provide more reliable temperature detection.

In this way, even with a small detection area of the temperature detecting element, it is possible to make temperature detection without malfunction by discharging the ink while the recording head is moved, thereby dispersing ink droplets over a large range to extend the detectable area.

Note that this embodiment, like the embodiment 1-1, can also utilize an ink jet recording head using piezo-electric (piezo) elements which are electromechanical transducers, instead of electricity-heat converters for ink discharge. In such recording head using piezo-electric elements, if there is a difference between the temperature of ink droplets and the ambient temperature, the ink discharge can be detected, whereby it is possible to realize the power-saving by varying the heating temperature with heating means depending on the ambient temperature.

Embodiment 1-3

Figure 11:
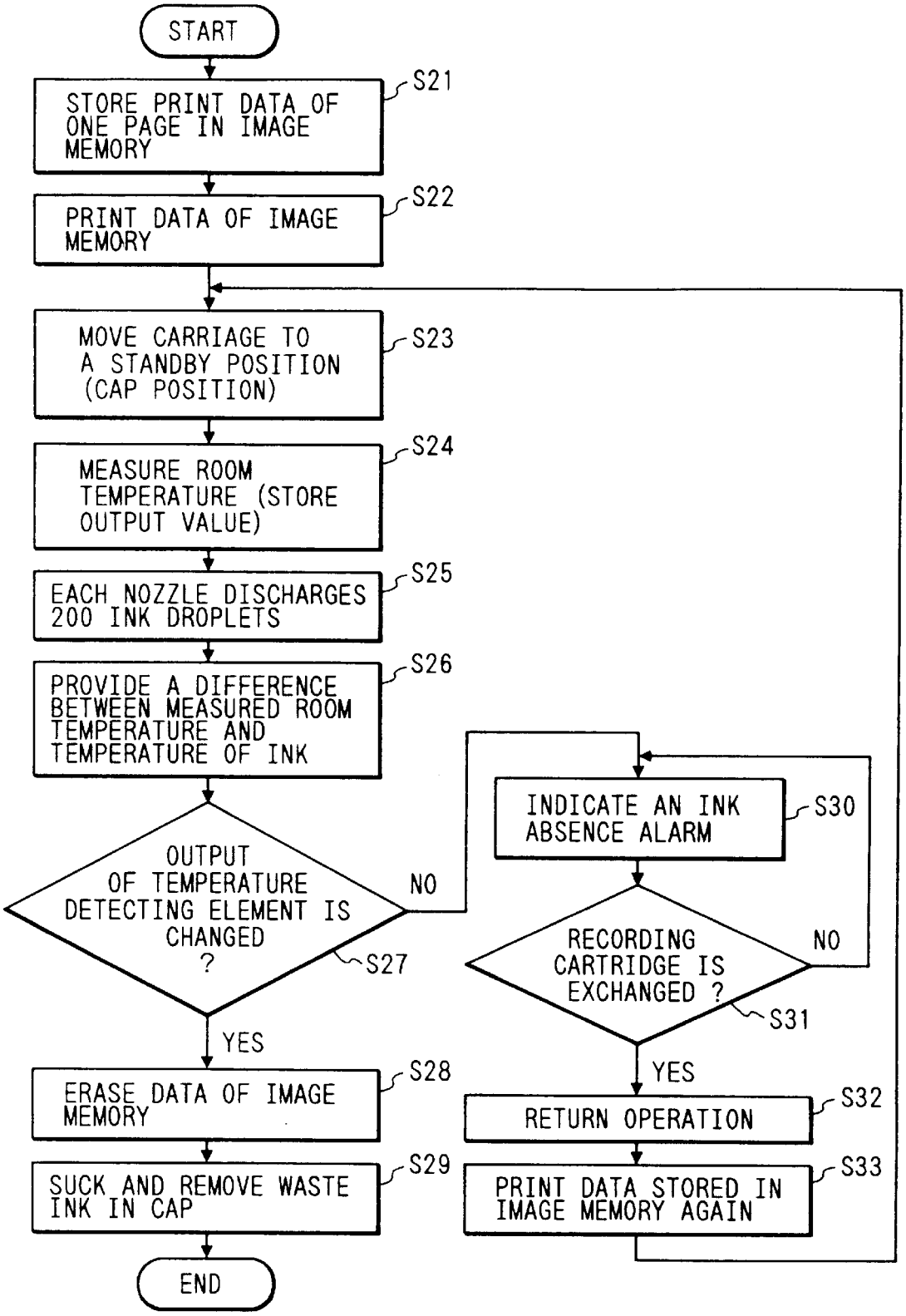
FIG. 11 is a flowchart showing the sequence of detecting the presence or absence of ink discharge according to another embodiment.

While in the second embodiment as above described, the ambient temperature detecting element is provided apart from the temperature detecting element, and the presence or absence of ink discharge is judged based on the difference between the temperature detected by the temperature detecting element and the ambient temperature (room temperature), it should be noted that the substantially same effects can be obtained by altering the detection sequence using only the temperature detecting element, like the embodiment 1-1, without using the ambient temperature detecting element. FIG. 11 is a flowchart showing such a sequence. The different point from that shown in FIG. 5 is that after the carriage member 2 is moved to a stand-by position (cap position) at step S23, the ambient temperature is measured using a temperature detecting element 16 and its output value is temporarily stored in a RAM 27 of the control unit 21 (step S24), and after each nozzle is caused to discharge 200 ink droplets, the output change of the temperature detecting element 16 is checked by detecting the difference between the output value of temperature detecting element 16 and that before ink discharge temporarily stored as previously described, whereby the presence or absence of ink discharge is judged.

The block diagram showing the schematic configuration of a main portion of the recording apparatus in embodiment 1-3 is the same as that shown in FIG. 4, and the detection circuit 29 is the same as that shown in FIG. 6. In the embodiment 1-3, if the interval between the measurement of the ambient temperature at step S24 and the temperature measurement with the temperature detecting element 16 after ink discharge at step S26 is made very short, e.g., about several hundreds msec, the change in the ambient temperature within this interval can be substantially ignored.

Embodiment 1-4

In this embodiment 1-4, an ink absorbing member is provided around the periphery of the temperature detecting element 16, and if an ink droplet adhering to the surface of temperature detecting element 16 grows to some extent of volume the ink droplet is contacted with and absorbed into the ink absorbing member to prevent the ink droplet from growing beyond a certain size.

Figure 12:
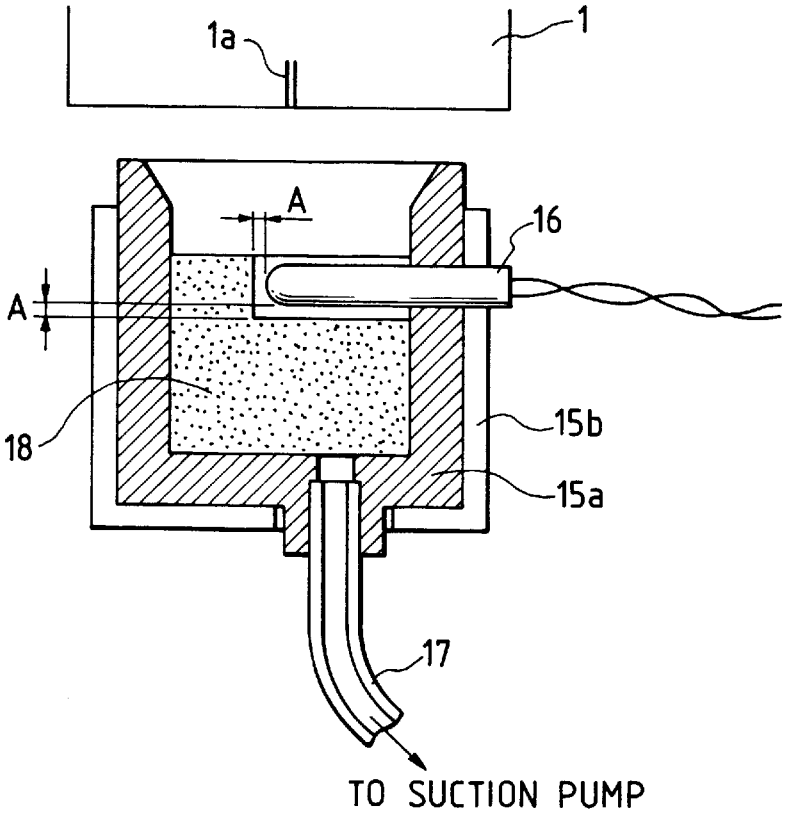
FIG. 12 is a cross-sectional view showing the structure of a cap unit in the ink jet recording apparatus according to another embodiment.

As previously described, the ink within the cap 15 is removed by a suction pump, not shown, but in order not to degrade the sensitivity or thermal response ability, it is desirable to remove as many ink droplets adhering to the temperature detecting element 16 as possible. In this embodiment 1-4, the shape of ink absorbing member 18 is devised as shown in FIG. 12, and the distance A between the temperature detecting element and the ink absorbing member is set so that if an ink droplet reaches a size A as shown in FIG. 12, the ink droplet is absorbed into the ink absorbing member, and prevented from further growing. It is preferable that this distance A is 2 mm or less.

In this way, by setting the distance between the temperature detecting element 16 and the ink absorbing member 18 at a predetermined value, it is possible to prevent the sensitivity or thermal response ability caused by adhering ink from degrading, and improve the detection precision of the temperature detecting element 16.

Embodiment 1-5

The embodiment 1-5 is that the surface of temperature detecting element 16 is made water repellent so that the ink may be unlikely to adhere to the surface of temperature detecting element 16. In particular, it is preferable that the surface of temperature detecting element 16 is thinly coated with water repellent material not to make the thermal response ability worse.

The method of making water-repellent the surface of temperature detecting element 16 may include forming at least the surface of temperature detecting element 16 with a water repellent material. For example, there are methods that the temperature detecting element 16 is dipped in a dispersant having the powder of water repellent material dispersed, or coated with said dispersant, and then burned by heating, or that the temperature detecting element 16 is dipped in a dispersant having the powder of water repellent material dispersed, or coated with said dispersant, and then cured by irradiation of ultraviolet ray, or that the surface of temperature detecting element 16 is pasted (lined) with a film made of water repellent material, or that when the water repellent material is polyolefine type, the temperature detecting element 16 is coated with the powder of this water repellent material, and then deposited by heating.

The material having high water repellency is preferably a fluororesin or a polyolefine type resin from the aspect of ink resistance. Specifically, examples of fluororesin material may include tetrafluoroethylene resin, perfluoroalkoxy resin, tetrafluoroethylene-hexafluoropolypropylene copolymer resin, and fluorovinylidene resin, and examples of polyolefine type resin may include polyethylene and polypropylene.

This embodiment 1-4 is intended to prevent the false detection that the absence of ink is judged despite of some quantity of ink remain because discharged ink droplets may adhere to the temperature detecting element 16 to inhibit the sensitivity or thermal response ability of the temperature detecting element 16, and to prevent ink droplets left intact and stiffened on the temperature detecting element 16 from degrading the sensitivity or thermal response ability.

Further, with a combination of the embodiment 1-5 and the embodiment 1-4, it is possible to facilitate the removal of ink adhering to the surface of temperature detecting element 16, further enhancing the effects of the embodiment 1-4.

If the operation of detecting the presence or absence of ink discharge, that is, undischarge due to ink shortage, based on the presence or absence of rise in temperature by causing ink droplets heated by the recording head to impinge directly against the temperature detecting means provided within the cap as above described, is performed for each recording of one sheet, for example, there is the advantage that there is no need for providing any special detecting member on the recording head or ink tank. In particular, this is an effective method as ink absence detecting means applicable to the so-called disposable type head in which the recording head and the ink tank are integrally formed, and exchanged for new one if the ink is used up.

Next, an embodiment with a second constitution of the present invention will be described.

Where the ink absence is detected with the above method, there is a case that complete nondischarge does not take place at once when the ink is used up, but a transient state may take place, for example, incomplete unstable discharge or intermittent discharge may take place, owing to various unstable factors inside of the recording head, whereby there is a risk that the false detection may occur. That is, this occurs with such a case that though the ink is almost used up and printing is obscure, the discharge is normally performed only at the detection time so that the apparatus can not recognize the ink absence. Such a false detection becomes a particularly serious problem associated with the unmanned recording machine such as a facsimile apparatus.

This embodiment is such that the amount of discharged droplets per unit time is made greater than normally in such a way as to perform the discharge to the temperature detecting means at a higher frequency than when the normal print is performed, or discharge larger droplets, so that more negative pressure is generated within the liquid channel by the discharge to cause undischarge due to absence of ink at earlier time, thereby preventing the occurrence of transient state.

A series of sequence control as shown in FIG. 5 has a feature that, when 200 droplets are discharged at step S4, the ink is discharged at a higher frequency than the maximum frequency for the normal print. This feature is able to prevent malfunctions, such as obscure printing or intermittent occurrence of nondischarge, owing to the transient phenomenon arising immediately before nondischarge caused by the absence of ink.

Figure 13:
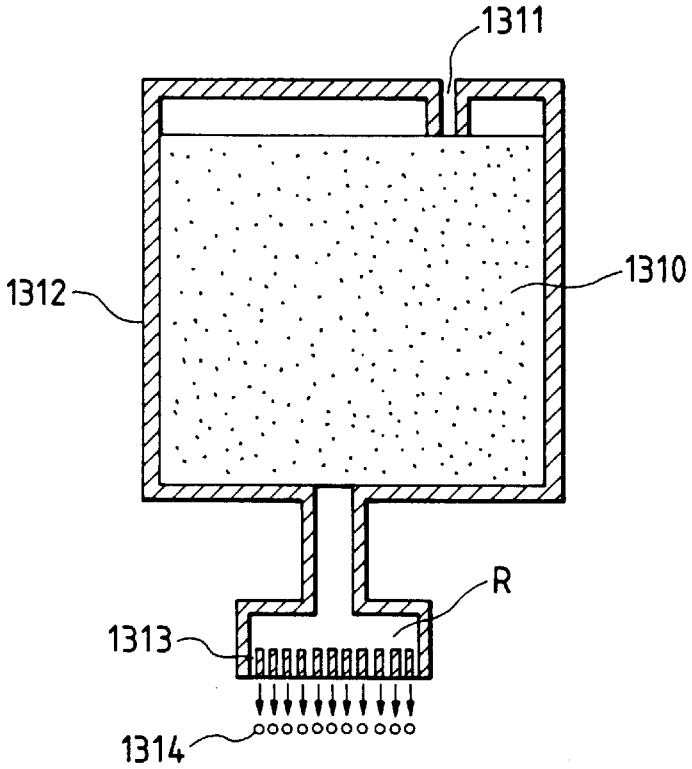
FIG. 13 is a schematic view showing the interior of a recording head.
Figure 14:
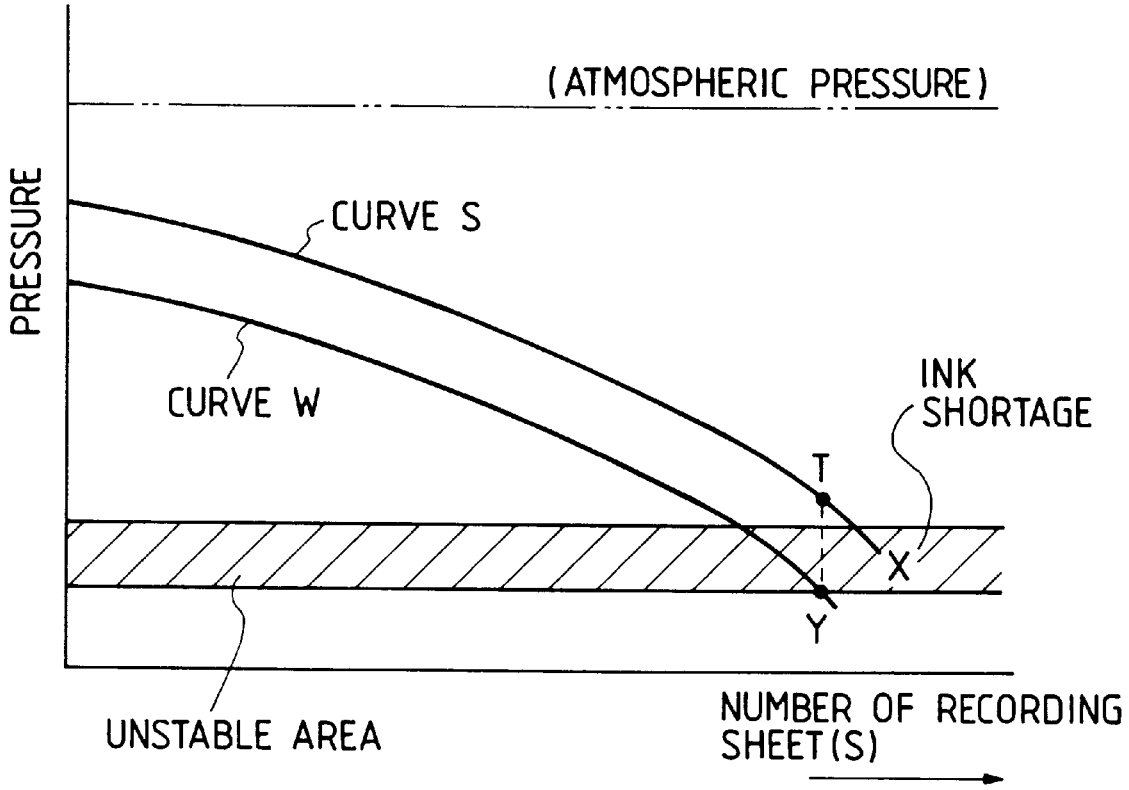
FIG. 14 is a graph showing how the pressure at a point R within a head liquid chamber of FIG. 13 changes with increasing number of recording sheets (ink consumption), when the ink is discharged from the head at the maximum frequency of the normal printing.

To explain this operation, the internal pressure change and ink discharge condition of the ink jet recording head will be described. FIG. 13 is a schematic view showing the inside of recording head, and FIG. 14 shows how the pressure at a point R within the head liquid chamber of FIG. 13 changes with increasing number of recording sheets (consumption of ink) when the head is caused to discharge the ink at the maximum frequency of the normal print.

A sponge member 1310 accommodated as negative pressure generating means within a common liquid chamber 1312 retains the ink supplied through an inlet port 1311 due to capillary action. The pressure at the point R is a negative pressure with reference to the atmospheric pressure, because the ink retained in the sponge member 1310 is discharged from each ink discharge port 1313 a fixed amount of discharged droplets. This negative pressure gradually increases (pressure drop) as shown by a curve S in FIG. 14, because the capillary action generated by the sponge member 1310 increases when the ink remain decreases. If the negative pressure reaches a certain level, the force tending to discharge the ink can not overcome the negative pressure, resulting in nondischarge, and then shortage of ink, but this boundary may fluctuate due to numerous unstable factors of the situation in which the recording head is placed, whereby it is considered that an unstable region having a certain width as shown in FIG. 14 exists. In this unstable region, the actual obscure printing or the intermittent occurrence of nondischarge may take place, and there is such a rare case that even though the ink is almost used up and the printing is obscure, the discharge may be normally performed only at the time of detection, so that the apparatus can not recognize the absence of ink normally.

In this embodiment, to cope with such failures, the discharge at the time of detection is made at a higher frequency than the normal maximum frequency. If the frequency is higher, the outflow amount of ink increases, so that the negative pressure increases, as represented by a curve W in FIG. 14. Accordingly, for example, even if nondischarge is detected in accordance with the number of recording sheets as indicated at a point Y, taking into consideration the unstable region, that number is still located at a point T in the normal print frequency region, so that the nondischarge is detected before the unstable region is entered. Namely, if the nondischarge is caused to occur at earlier time, and the absence of ink is notified, the previously-mentioned malfunctions can be avoided.

Embodiment 2-1

FIG. 15 is a block diagram showing the configuration of a first embodiment for changing the amount of discharged liquid droplets.

This embodiment has a clock circuit 1501 provided between a control unit 21 and a head driving circuit 33 in the block diagram as shown in FIG. 4. Other configuration is the same as that shown in FIG. 4, and the explanation thereof is omitted with the same numerals attached.

The method of changing the amount of discharged liquid droplets in this embodiment is as follows.

The head driving circuit 33 as shown in FIG. 15 is connected to the clock circuit 1501 to determine its discharge amount. The clock control circuit 1501 is configured to generate two kinds of frequency of 3 KHz and 4 KHz upon a command from the control unit 21. The ink jet recording head for use with this embodiment can exhibit the best performance at a frequency of 3 KHz, whereby data is sent out at a clock frequency of 3 KHz in the normal print and then printed. On the contrary, when 200 droplets are discharged at step S4 in FIG. 5, CPU 23 within the control unit 21 selects the clock of 4 KHz, enabling the discharge at a higher frequency than normally. To make such a control, ROM 25 stores two kinds of clock switching operation as the recording procedure, so that a series of recording operations are automatically performed.

The present invention is also applicable to the other method in which the absence of ink is notified by discharging the ink periodically, and confirming that the discharge is completely made, for example, a method in which a trial discharge pattern is recorded on a portion of recording sheet, and read to determine whether the pattern is present or absent by an optical sensor.

Likewise, the present invention is applicable to a method in which with temperature detecting means provided within the recording head, the difference is checked between elevated temperatures when discharge is completely made and when discharge is not made due to absence of ink.

Embodiment 2-2

Figure 16:
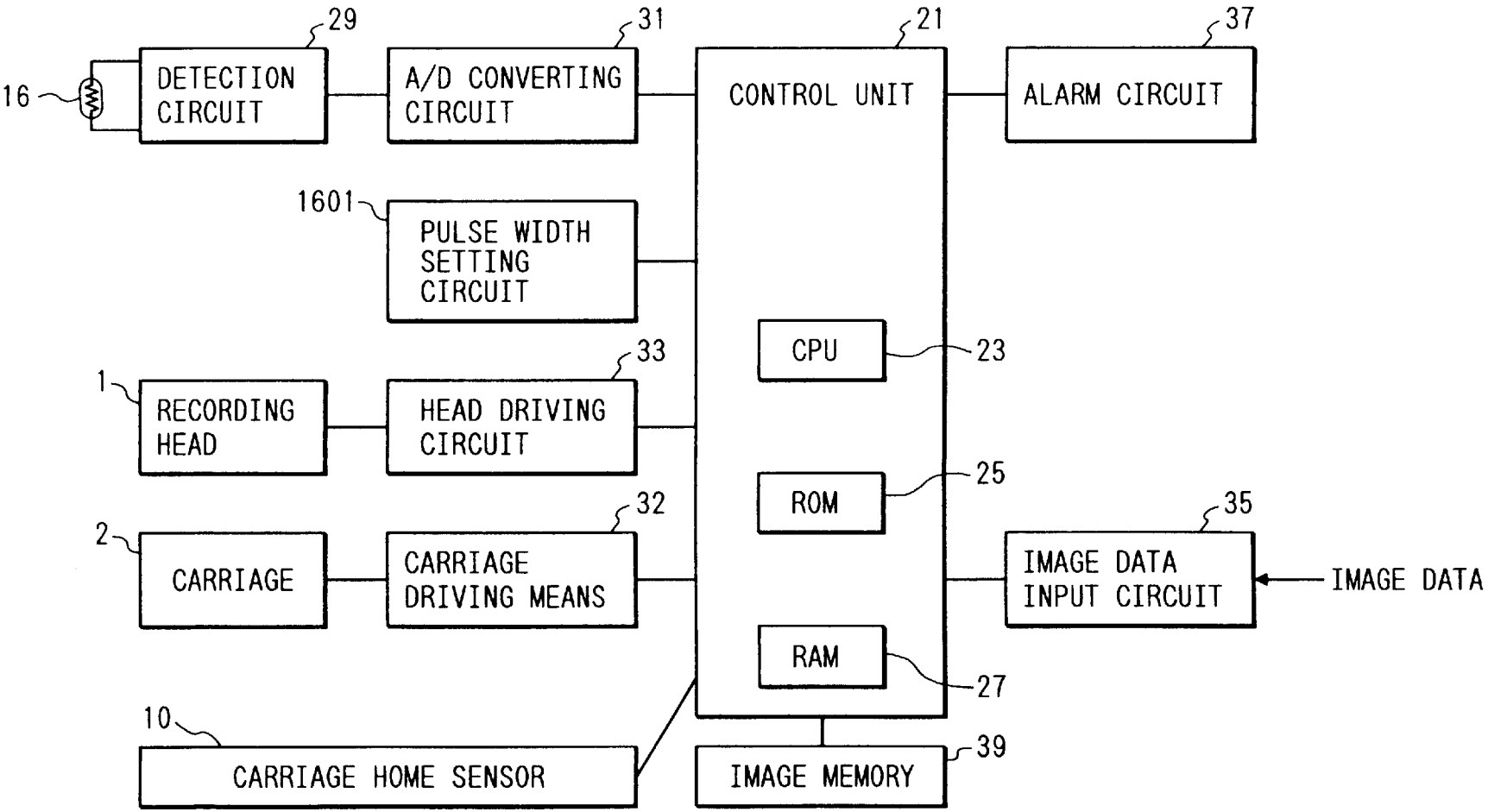
FIG. 16 is a diagram showing the configuration of a second embodiment for changing the amount of discharged droplets.

FIG. 16 is a block diagram showing the configuration of a second embodiment for changing the amount of discharged liquid droplets.

This embodiment has a pulse width setting circuit 1601 provided between the control unit 21 and the head driving circuit 33 in the block diagram as shown in FIG. 4. Other configuration is the same as that shown in FIG. 4, and the explanation thereof is omitted with the same numerals attached.

The method of changing the amount of discharged liquid droplets in this embodiment is as follows.

The head driving circuit 33 as shown in FIG. 15 is connected to the pulse width setting circuit 1601 for determining the width of discharge pulse. The pulse width setting circuit 1601 is configured to have two settable pulse widths of 7 μs and 10 μs upon a command from the control unit 21. The ink jet recording head for use in this embodiment is designed to exhibit the best print performance at a pulse width of 7 μs, wherein the amount of liquid droplets at this pulse width is 80 ng. In the normal print, the printing is performed at a pulse width of 7 μs, but when 200 droplets are discharged at step S4 in FIG. 5, the CPU 23 within the control unit 21 selects the pulse width of 10 μs. If the pulse width is 10 μs, the applied energy increases about 40%, resulting in increased discharge power. At the same time, the ink viscosity may reduce due to temperature elevation of the head, so that the amount of liquid droplets increases to 90 ng.

As above described, the amount of liquid droplets can be changed by switching the pulse width. To make such a control, the ROM 25 stores an operation program of switching two pulse widths as the recording procedure, whereby a series of recording operations are automatically performed.

In the above-described embodiment, the timing of notifying the absence of ink occurs more early by using a higher discharge frequency at the time of detection than normally, but it will be appreciated that as it is only necessary to increase the amount of discharged liquid droplets per unit time, the same effects can be also achieved by increasing the amount of pulse energy applied to the recording head and providing a larger liquid droplet discharged.

The present invention is also applicable to the other method in which the absence of ink is notified by discharging the ink periodically, and confirming that the discharge is completely made, for example, a method in which a trial discharge pattern is recorded on a portion of recording sheet, and read to determine whether the pattern is present or absent, by an optical sensor.

Likewise, the present invention is applicable to a method in which with temperature detecting means provided within the recording head, the difference is checked between elevated temperatures when discharge is completely made and when discharge is not made due to absence of ink.

Next, an embodiment of a third configuration of the present invention will be described.

As with each method as above described, when the absence of ink is detected, it is apprehended that a considerable amount of ink may be consumed to make detection, so that the waste ink and the running costs increase.

This embodiment is to resolve the above problem by restricting the discharge nozzles to be used for detection to some part of them, so that the amount of used ink is reduced, and the waste ink and the running costs are reduced.

In this embodiment, in a series of sequence control, as shown in FIG. 5, 200 droplets at step S4 are discharged only by nozzles provided opposite a detecting portion of the temperature detecting element 16 of the recording head 1.

Embodiment 3-1

Figure 17:
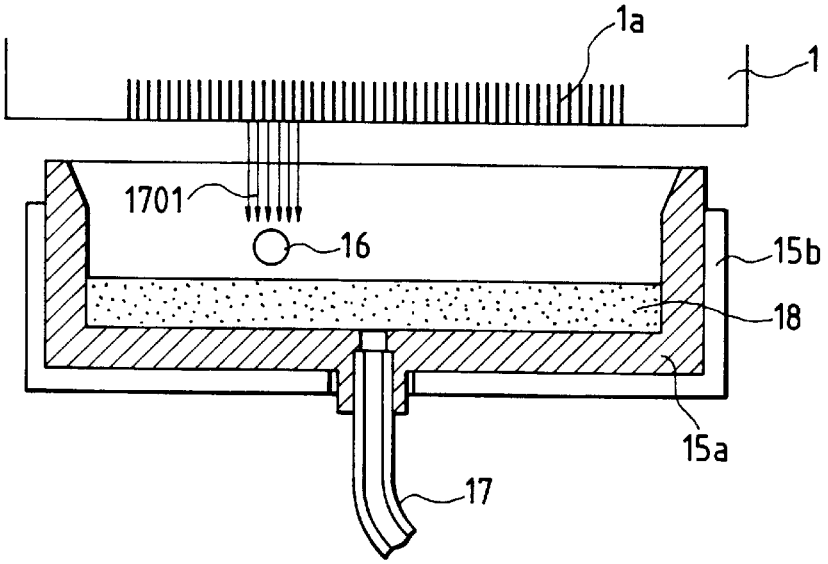
FIG. 17 is a view for explaining the ink discharge condition in a third embodiment of the invention.

FIG. 17 shows a detected discharge condition when this embodiment is applied. FIG. 17 is a cross-sectional view of the cap 15 as shown in FIG. 3 taken along the central line of the suction tube 17.

The recording head 1 for use in this embodiment has 64 nozzles 1*a*, with a resolution of 360 dots/inch, and thus has a discharge width of about 4.5 mm, but a corresponding detecting portion of the temperature detecting element 16 has only a width of about 1 mm, whereby even if the discharge operation with all the nozzles is performed, the ink not making contact with this portion will be wastefully consumed without participating in the detection. Accordingly, by using only this portion of 1 mm as a discharge region 1701, the ink which is wastefully used in the other portion can be saved. The setting of discharge region in this embodiment is as follows.

The ROM 25 in the block diagram as shown in FIG. 4 is provided with a storage area for storing a discharge pattern corresponding to a discharging portion and a non-discharging portion when detection is made.

The CPU 23 refers to data of this area when detection 5 is made and sends out a discharge pattern stored therein as discharge data to the head driving circuit 33. In this embodiment, because the detecting portion of the temperature detecting element 16 is about 1 mm width, as previously described, a pattern in which twenty nozzles opposite the detecting portion of the temperature detecting element 16 among 64 nozzles 1*a* participate in the discharge is written in the ROM 25.

Figure 18:
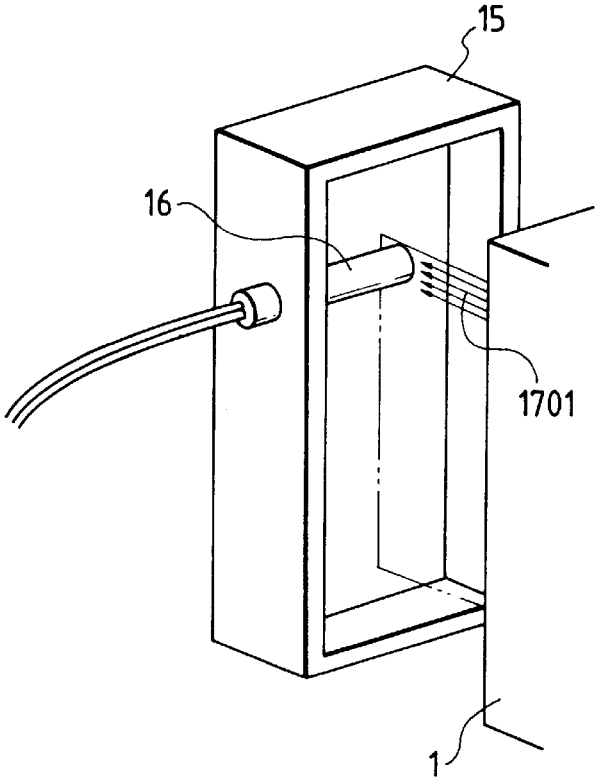
FIG. 18 is a view for explaining the ink discharge condition in the third embodiment of the invention.

While this embodiment has been described with a recording apparatus of the type in which the recording sheet is conveyed in a horizontal direction, and the ink is discharged downward from the recording head, it will be appreciated that the present invention is also applicable to a recording apparatus of the type in which the ink is discharged transversely (along a vertical direction) from the recording head and the recording sheet is conveyed from the lower side upwardly. In this case, it is further preferable to provide a detection and discharge region on the top portion of the recording width, as shown in FIG. 18. This is due to the fact that in the type in which the ink is discharged downwardly from the recording head, substantially equal negative pressure occurs in each nozzle, with the probability of nondischarge being equal irrespective of the position of discharge nozzle, but in the type in which the ink is discharged transversely from the recording head, greater negative pressure occurs in upper nozzles in the recording width due to the action of gravity, which result in higher probability of nondischarge. Therefore, there is such a case that even if the discharge is confirmed on the lower side, the nondischarge may occur on the upper side, whereby the detection and discharge region provided on the top portion of the recording width allows the discharge condition to be confirmed securely without giving rise to any of the failures as above mentioned.

The discharge region is not necessarily provided as a block, but may be of a comb or stagger shape of selected discharge ports as long as the detected signal level can be sufficiently obtained.

Also, the same effects can be expected in the other method in which the absence of ink is notified by discharging the ink periodically, and confirming that the discharge is completely made, for example, a method in which a trial discharge pattern is recorded on a portion of recording sheet and read to determine whether the pattern is present or absent by recording the trial discharge pattern by the use of a part of the nozzles.

Likewise, the present invention is applicable to a method in which with temperature detecting means such as a thermistor provided within the recording head, the presence or absence of ink is confirmed by checking the difference between elevated temperatures when discharge is completely made and when discharge is not made due to the absence of ink.

Next, an embodiment of a fourth configuration of the present invention will be described.

As with each method as above described, when the ink absence detection is made, and the recording head is exchanged because the absence of ink is detected, there is a risk that if there is no difference in external appearance between a new recording head and the recording head without ink, the recording head without ink may be mounted again by mistake.

This embodiment is to resolve the above problem by providing means which allows the user to manually perform the ink absence detection, in addition to automatic detection for each page which is normally performed, thereby allowing the user to confirm that when the recording head is exchanged, a recording head to be mounted contains the quantity of ink to avoid the above inconvenience.

Embodiment 4-1

Figure 19:
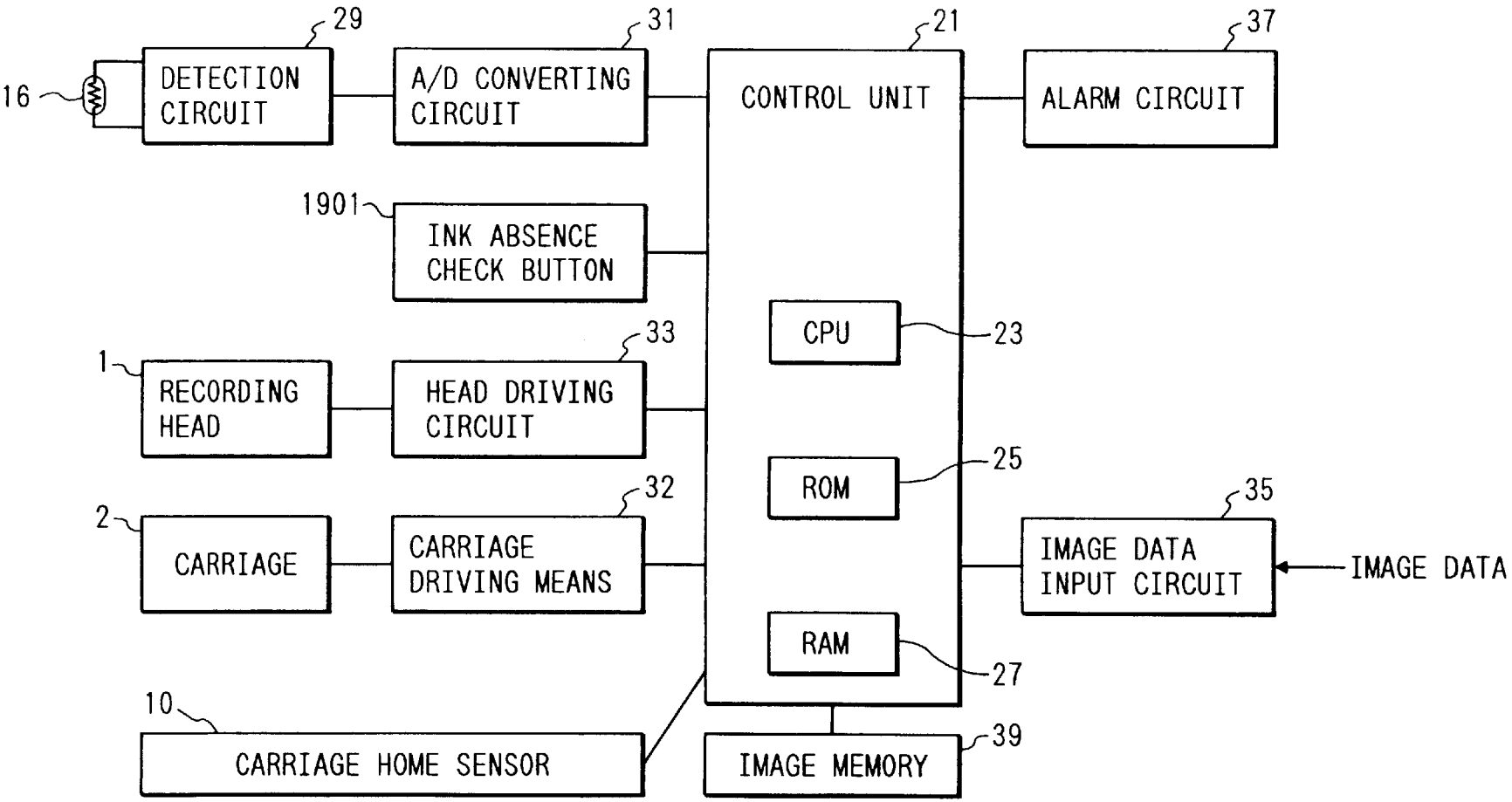
FIG. 19 is a block diagram showing the configuration of a fourth embodiment of the invention.
Figure 20:
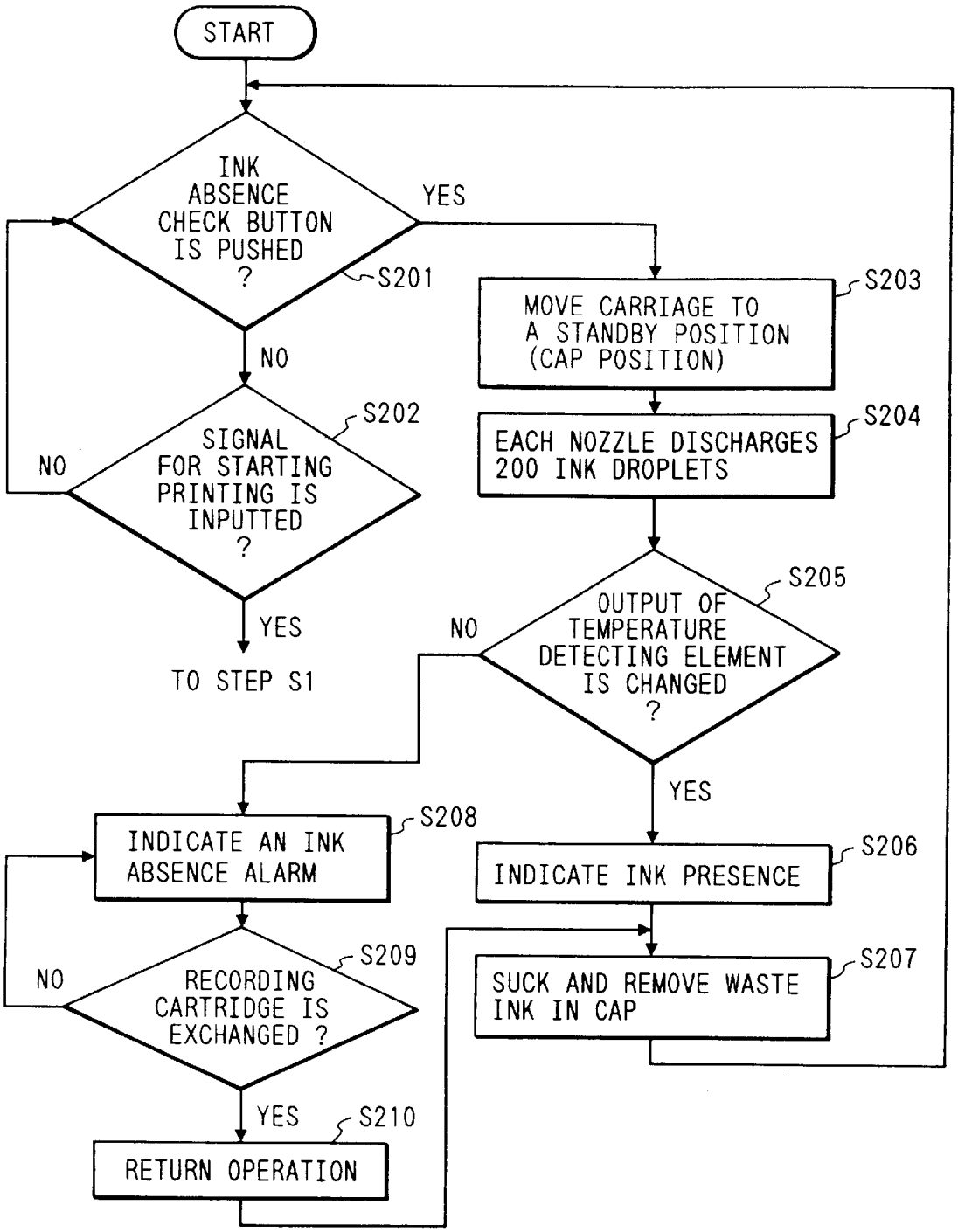
FIG. 20 is a flowchart showing the essence of control operation in the embodiment as shown in FIG. 19.

FIG. 19 is a block diagram showing the configuration of this embodiment, and FIG. 20 is a flowchart showing the essence of control operation in this embodiment.

This embodiment is provided with an ink absence check button 1901 for enabling the ink absence check to be performed by the control unit 21 in the block diagram as shown in FIG. 4. Other configuration is the same as that shown in FIG. 4, and the explanation thereof is omitted with the same numerals attached.

The operation of this embodiment will be described with reference to FIG. 20.

In a stand-by state other than for the recording operation, the CPU 23 monitors that the ink absence check button 1901 is pushed as shown in FIG. 20 (step S201). If the ink absence check button 1901 is not pushed, the CPU 23 monitors that a signal for starting printing is input (step S202), and if that signal is input, the procedure jumps to step S1 in the flowchart as shown in FIG. 5.

If the ink absence check button 1901 is pushed at step S201, the carriage 2 is moved to stand-by position (cap position) (step S203), and 200 droplets are discharged from each of all nozzles of the recording head 1 (step S204). Thereafter, if the output of temperature detecting element 16 is changed (step S205), the ink presence is displayed on a display unit, not shown, (step S206), and waste ink within the cap is sucked and removed (step S207). Then the procedure returns to step S201.

If the output of temperature detecting element 16 is not changed at step S205, an alarm message indicating the ink absence is displayed on the display unit as previously described (step S208). Thereafter, if the recording cartridge is exchanged (step S209), a predefined return operation is performed (step S210), and the procedure transfers to step S207. If the recording cartridge is not exchanged, the procedure transfers to step S208, where an alarm message is displayed again to prompt the user to exchange the recording cartridge.

This embodiment permits the user to know the presence or absence of ink at any time. That is, this embodiment provides such control means that if the ink presence is detected, a message "ink present" is displayed on the display unit, not shown, while if it is not detected, an ink absence alarm is displayed.

In this way, when the recording head is exchanged, a confirmation as to whether or not there remains the ink can be made, whereby the recording head which is empty is prevented from being mounted by mistake.

While in the above-described embodiment, the discharge operation at step S204 for ink detection is performed through all the nozzles, it will be naturally understood that it can be performed through a part of the nozzles as in the third configuration of the present invention.

This embodiment is also applicable to the other method in which the absence of ink is notified by discharging the ink periodically, and confirming that the discharge is completely made, for example, a method in which a trial discharge pattern is recorded on a portion of recording sheet, and read to determine whether the pattern is present or absent, by an optical sensor.

Figure 21:
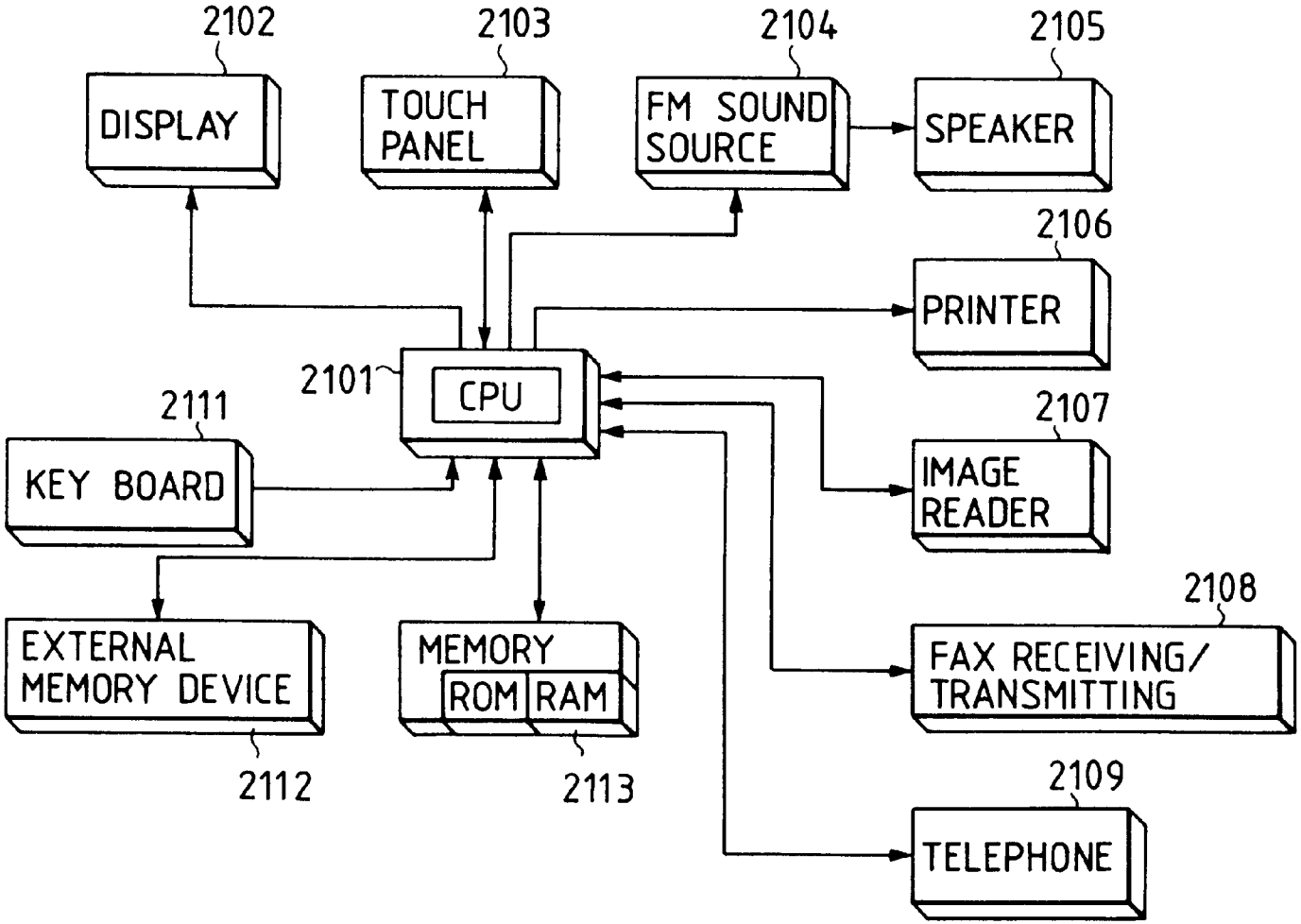
FIG. 21 is a block diagram showing a schematic configuration in which a recording apparatus as shown in the above embodiments is applied to an information processing apparatus having the features of a word processor, a personal computer, a facsimile apparatus and a copying apparatus.

FIG. 21 is a block diagram showing a schematic configuration in which a recording apparatus of the present invention is applied to the information processing apparatus having the features of word processor, personal computer, facsimile terminal equipment, and copying machine. In the figure, 2101 is a control unit for controlling the whole apparatus, wherein it comprises a CPU such as a microprocessor or various I/O ports, and controls by outputting or inputting a control signal or data signal to or from each of sections, respectively. 2102 is a display section, which displays various kinds of menus, document information, and image data read by an image reader 2107 on the display screen. 2103 is a transparent, pressure sensitive touch panel provided on the display section 2102, which enables the entry of an item or coordinate value on the display section 2102 by depressing its surface with a finger or the like.

2104 is an FM (Frequency Modulation) sound source section, which makes the FM modulation for the music information created on the music editor, which is stored in and read from a memory 2110 or an external storage device 2112 as the digital data. An electrical signal from the FM sound source section 2104 is converted into audible sound by a speaker section 2105. A printer section 2106 is useful as the output terminal for a word processor, a personal computer, a facsimile terminal equipment or a copying machine, to which a recording apparatus according to the present invention is applied.

2107 is an image reader section which reads original data photoelectrically, and is provided midway on the conveying path of original to read a facsimile or copying original, and other various types of original. 2108 is a FAX receiving/transmitting section for FAX transmitting original data read by the image reader section 2107 or for FAX receiving facsimile signals that are transmitted, having an interface facility with the outside. 2109 is a telephone section, comprising various telephone features, such as ordinary telephone or automatic answering telephone. 2110 is a memory section comprising a ROM for storing system programs, manager programs and other application programs, character fonts, and dictionaries, a RAM for storing an application program loaded from the external storage device 2112 and character information, and a video RAM.

2111 is a keyboard section for inputting document information or various commands. 2112 is the external storage device which is a storage medium consisting of floppy disk or hard disk, wherein this external storage device 2112 is used to store character information, music or audio data, and user's application programs.

Figure 22:
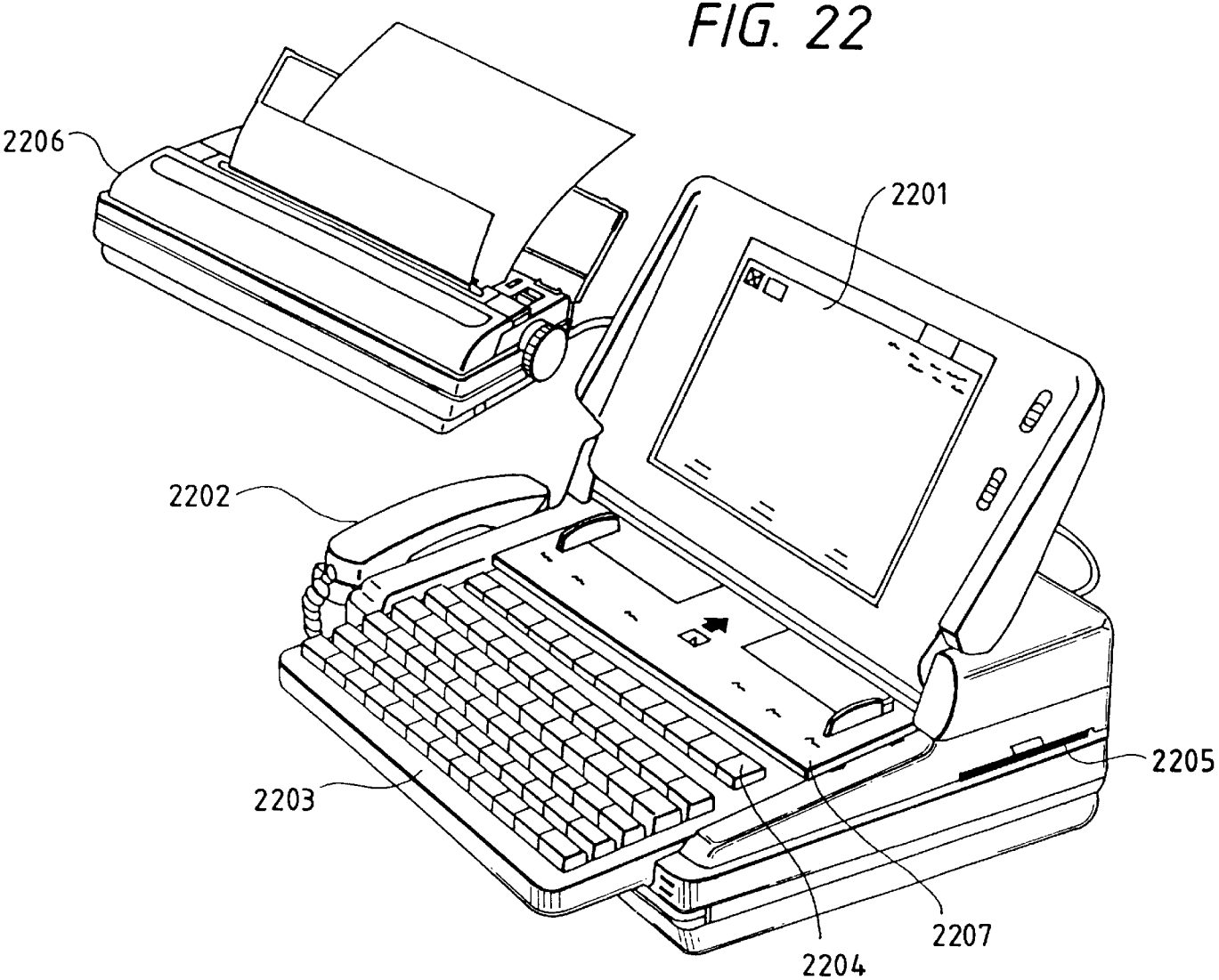
FIG. 22 is an external view of the information processing apparatus as shown in FIG. 21.

FIG. 22 is an appearance view of the information processing apparatus as shown in FIG. 21. In the figure, 2201 is a flat panel display formed of a liquid crystal for displaying various kinds of menus, graphic data or document information. On this display 2201 is installed the touch panel, which enables the entry of coordinate or specified item by depressing the surface of the touch panel with a finger or the like. 2202 is a handset to be used when the apparatus functions as a telephone.

A keyboard 2203 is detachably connected via a cord to a main device, and is used to input various character information or data. The keyboard 2203 is also provided with various function keys 2204. 2205 is an opening for insertion of the floppy disk.

2207 is a paper laying board for laying thereon a paper to be read by the image reader section 2107, in which a read paper is exhausted from the rear side of device. In the facsimile reception, received data is recorded by an ink jet printer 2207.

It should be noted that the display section 2201 may be a CRT, but is preferably a flat panel such as a liquid crystal display using a ferroelectric liquid crystal. This is because the display can be made more compact, thinner, and lighter. When the above mentioned information processing apparatus functions as a personal computer or word processor, various information input from the keyboard 2111 in FIG. 16 are processed according to a predetermined program by the control unit 2101, and output to the printer 2106 as the image. When it functions as a receiver for the facsimile terminal equipment, the facsimile information input from the FAX receiving/transmitting section 2108 via the transmission line are received according to a predetermined program by the control section 2101, and output to the printer section 2106 as the received image.

Figure 23:
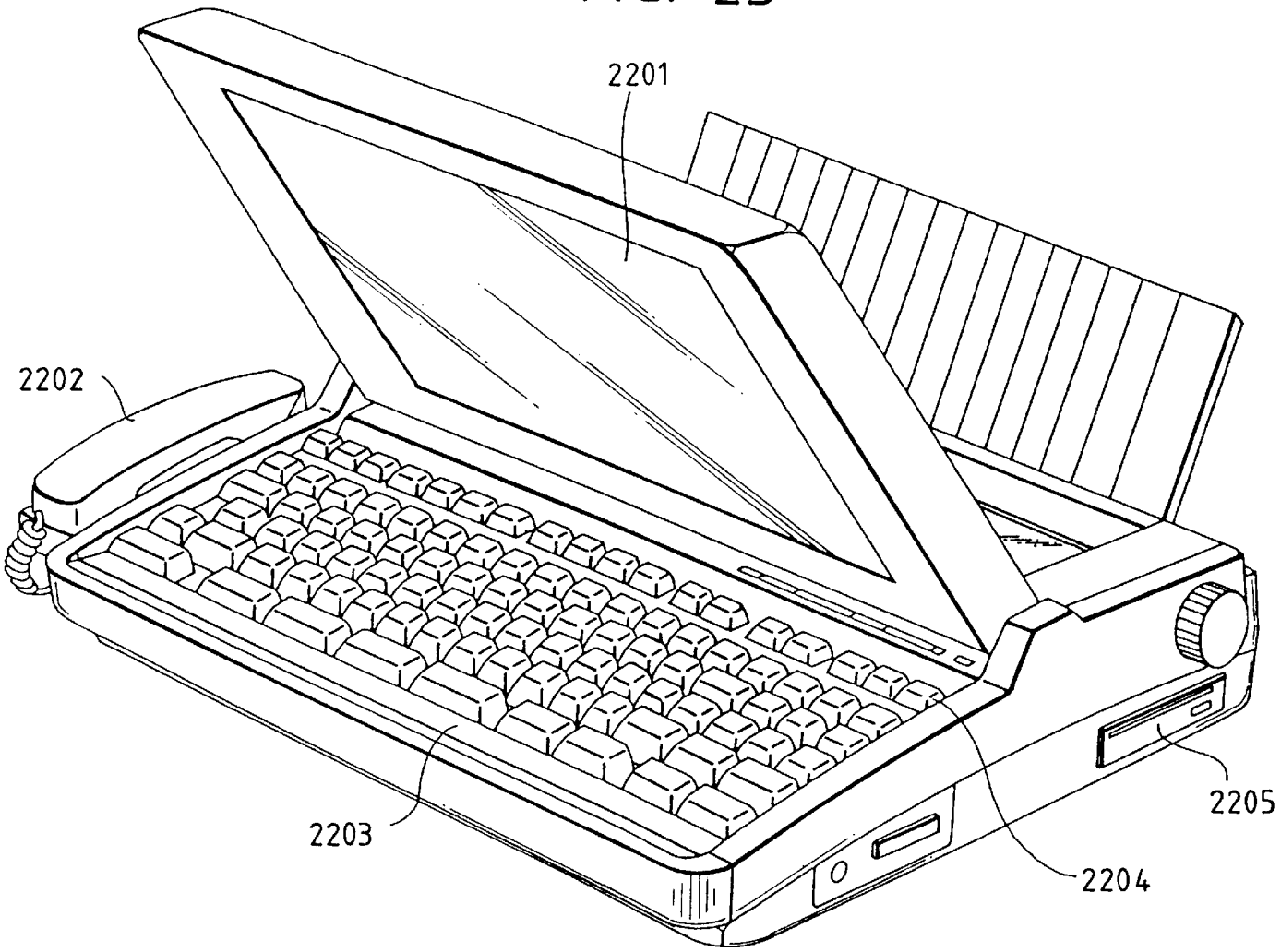
FIG. 23 is an external view of the information processing apparatus as shown in FIGS. 21 and 22 which is of the integral type.

And when it functions as a copying machine, an original is read by the image reader section 2107, and original data that was read is output via the control unit 2101 to the printer section 2106 as the copied image. Note that it functions as a transmitter for the facsimile terminal equipment, original data that was read by the image reader section 2107 is processed for transmission according to a predetermined program by the control unit 2101, and transmitted by the FAX receiving/transmitting section 2108 via the transmission line. It should be noted that the above mentioned information processing apparatus can be of the integral type in which an ink jet printer is contained within the main device as shown in FIG. 23, in which its portability can be enhanced. In the same figure, like reference numerals are affixed to parts having the same functions as those in FIG. 22.

Thus, if a recording apparatus according to the present invention is applied to the multifunctional information processing apparatus as above described, higher quality recording images can be obtained so that the features of the information processing apparatus can be further improved.

The present invention brings about excellent effects particularly in an ink jet recording apparatus for recording by forming flying ink droplets by the use of heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention. In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., to the recording head is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

Though the ink is considered as the liquid in the embodiments as above described, another ink may be also usable which is solid below room temperature and will soften or liquefy at or above room temperature, or liquefy when a recording enable signal is issued.

In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as liquefying with the application of heat energy in accordance with a recording signal so that liquid ink is discharged, or may solidify prior to reaching a recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on the film boiling.

Further, a recording apparatus according to the present invention may be used in the form of being provided integrally or separately as the image output terminal in an information processing equipment such as a word processor or computer, a copying machine in combination with a reader, or a facsimile terminal equipment having the transmission and reception feature.

In particular, when the recording apparatus is used as a recording unit for the facsimile terminal equipment, received image is once stored in memory and then recorded, the discharge monitor as previously described is performed for each one page of recording, and the contents of memory are erased after the confirmation that the normal print has been made, whereby when the ink is used up, received data which is stored in memory can be output again after the exchanging of the head.

The present invention which is constituted as above described can exhibit the following effects.

An ink jet recording apparatus and an ink discharge detecting method can be provided in which decreased ink remaining or ink nondischarge can be securely detected.

Also, it is possible to prevent the occurrence of such a failure that recording sheets are wastefully consumed or invaluable data is lost because the recording operation is continued despite of almost depletion of ink remain, so that the reliability of the recording apparatus can be improved.

Detection of the absence of ink remaining takes place when the ink remaining is almost depleted, whereby the ink is not wastefully used, resulting in reduced running costs.

In an ink jet recording apparatus in which the absence of ink is notified by monitoring the discharge to be completely performed in such a way as to discharge the ink periodically, for example, between pages, it is possible to prevent false detection due to unstable discharge condition immediately before the absence of ink, and to prevent the occurrence of such a failure that recording sheets are wastefully consumed, or invaluable data is lost because the recording operation is continued despite of almost depletion of ink remaining, so that the reliability of the recording apparatus can be improved.

Also, it is possible to reduce the amount of ink to be used for detecting the absence of ink. Therefore, the percent of the amount of ink to be used other than for the recording is lessened, resulting in increased recordable number of recording sheets and reduced running costs. The ink used for detection must be withdrawn as waste ink, but as this amount of ink will decrease, the waste ink tank can be made smaller, thereby contributing to the compactness of the entire apparatus.

Since the ink absence detection can be made at any time by the user, it is possible to judge the ink remain by executing the ink absence detecting operation even by using such a recording head that the ink remain is not known from the outside. Therefore, it is possible to prevent the recording head which is empty from being mounted by mistake, thereby eliminating wasteful consumption of recording sheets.

What is claimed is:

1. An ink jet recording apparatus for recording using a recording head which discharges heated ink onto a recording medium through discharge ports, said apparatus comprising:

temperature detecting means, contactable with the ink discharged through said discharge ports, for detecting a temperature change arising upon contact with said ink;

positioning means for positioning said recording head and said temperature detecting means at relatively opposed locations so that the ink discharged through said discharge ports may make contact with said temperature detecting means;

discharge detecting means for detecting discharge or nondischarge of ink based on a detected result of said temperature detecting means;

varying means for varying a number of discharged ink droplets per unit time; and a control circuit for controlling said varying means so that said number of discharged ink droplets per unit time in making discharge detection by said discharge detecting means may be different from that during the recording.

2. The ink jet recording apparatus according to claim 1, wherein said control circuit controls the number of discharged ink droplets per unit time to be greater in making discharge detection than during the recording.

3. The ink jet recording apparatus according to claim 1, wherein within said recording head or an ink reservoir connected to said recording head, there is provided negative pressure generating means for maintaining an inside of said recording head at a negative pressure when the ink is discharged.

4. An ink jet recording apparatus for recording using a recording head which discharges heated ink onto a recording medium through discharge ports, the apparatus comprising:

temperature detecting means, contactable with the ink discharged through said discharge ports, for detecting a temperature change arising upon contact with said ink;

positioning means for positioning said recording head and said temperature detecting means at relatively opposed locations so that the ink discharged through said discharge ports may make contact with said temperature detecting means;

discharge detecting means for detecting discharge or nondischarge of ink based on a detected result of said temperature detecting means;

varying means for varying a volume of discharged ink droplets per unit time; and a control circuit for controlling said varying means so that said volume of discharged ink droplets per unit time in making discharge detection by said discharge detecting means may be different from that during the recording.

5. The ink jet recording apparatus according to claim 4, wherein said control circuit controls the volume of discharged ink droplets per unit time to be greater in making discharge detection than during the recording.

6. The ink jet recording apparatus according to claim 4, wherein within said recording head or an ink reservoir connected to said recording head, there is provided negative pressure generating means for maintaining an inside of said recording head at a negative pressure when the ink is discharged.

7. An ink jet recording apparatus for recording using a recording head which discharges heated ink onto a recording medium through discharge ports, the apparatus comprising:

temperature detecting means, contactable with the ink discharged through said discharge ports, for detecting a temperature change arising upon contact with said ink;

positioning means for positioning said recording head and said temperature detecting means at relatively opposed locations so that the ink discharged through said discharge ports may make contact with said temperature detecting means; and discharge detecting means for detecting discharge or nondischarge of ink based on a detected result of said temperature detecting means, wherein said recording head is provided with a plurality of discharge ports arranged in a discharge port array, and when discharge detection is made by said discharge detecting means, a discharge condition from each of said plurality of discharge ports is selectable.

8. The ink jet recording apparatus according to claim 7, wherein said plurality of discharge ports are arranged in a vertical direction, and discharge ports located on an upper side of said recording head are placed in a discharge state when discharge detection is made by said discharge detecting means.

9. An ink jet recording apparatus for recording using a recording head having a plurality of nozzles which discharges the ink, the apparatus comprising:

discharge detecting means for detecting a presence or absence of ink discharge from said recording head;

varying means for varying a number of discharged ink droplets per unit time; and a control circuit for controlling the number of discharged ink droplets per unit time in making discharge detection by said discharge detecting means to be different from that during the recording, using said varying means.

10. The ink jet recording apparatus according to claim 9, wherein said control circuit controls the number of discharged ink droplets per unit time to be greater in making discharge detection than during the recording.

11. The ink jet recording apparatus according to claim 9, wherein within said recording head or an ink reservoir connected to said recording head, there is provided negative pressure generating means for maintaining an inside of said recording head at a negative pressure when the ink is discharged.

12. The ink jet recording apparatus according to claim 9, further comprising:

input means for indicating the start of discharge detection; and a control device for controlling discharge detection with said discharge detecting means to be performed periodically or when input is made into said input means.

13. An ink jet recording apparatus for recording using a recording head having a plurality of nozzles which discharge the ink, the apparatus comprising:

discharge detecting means for detecting a presence or absence of ink discharge from said recording head;

varying means for varying a volume of discharged ink droplets per unit time; and a control circuit for controlling the volume of discharged ink droplets per unit time in making discharge detection by said discharge detecting means to be different from that during the recording, using said varying means.

14. The ink jet recording apparatus according to claim 13, wherein said control circuit controls the volume of discharged ink droplets per unit time to be greater in making discharge detection than during the recording.

15. The ink jet recording apparatus according to claim 13, wherein within said recording head or an ink reservoir connected to said recording head, there is provided negative pressure generating means for maintaining an inside of said recording head at a negative pressure when the ink is discharged.

16. The ink jet recording apparatus according to claim 13, characterized by comprising:

input means for indicating a start of discharge detection; and a control device for controlling discharge detection with said discharge detecting means to be performed periodically or when input is made into said input means.

17. An ink discharge detecting method of an ink jet recording apparatus for recording using a recording head in which a discharge direction of ink discharged through a plurality of discharge ports onto a recording medium may lie in a horizontal direction or oblique to the horizontal direction, the method comprising the steps of:

discharging the ink from said discharge ports to make contact with an objective;

detecting a physical change occurring in said objective by the discharged ink; and detecting the discharge or nondischarge of ink based on a detected result of said physical change;

wherein when discharge detection is made, the ink is discharged selectively from discharge ports located upward in a vertical direction, among discharge ports of said recording head.

18. An ink discharge detecting method of an ink jet recording apparatus according to claim 17, wherein the ink discharged from said discharge ports onto a recording medium is heated, and the physical change occurring in said objective is a temperature change.

19. An ink discharge detecting method of an ink jet recording apparatus according to claim 17, wherein a number of discharged ink droplets per unit time is variable, and said number of discharged droplets per unit time in making discharge detection is made different from that during the recording.

20. An ink discharge detecting method performed with an ink jet recording apparatus having a recording head having a plurality of nozzles which discharge the ink, and discharge detecting means for detecting a presence or absence of ink discharge from said recording head, the method comprising the step of:

varying the number of discharged ink droplets per unit time, so that the number of discharged droplets per unit time in making discharge detection may be different from that during the recording.

21. An ink discharge detecting method of an ink jet recording apparatus according to claim 20, wherein the number of discharged ink droplets per unit time is made greater in making discharge detection than during the recording.

22. An ink discharge detecting method of an ink jet recording apparatus according to claim 20, wherein the discharge detection is made by judging a presence or absence of a detecting pattern recorded on part of a recording medium.

23. An ink discharge detecting method of an ink jet recording apparatus according to claim 20, wherein said recording head is an ink jet recording head for discharging the ink using heat energy, and said discharge detection is made by judging a difference between elevated temperatures of the recording head.

24. An ink discharge detecting method performed with an ink jet recording apparatus having a recording head having a plurality of nozzles which discharges the ink, and discharge detecting means for detecting the presence or absence of ink discharge from said recording head, the method comprising the step of:

varying a volume of discharge ink droplets per unit time, so that the volume of discharged droplets per unit time in making discharge detection may be different from that during the recording.

25. An ink discharge detecting method of an ink jet recording apparatus according to claim 24, wherein the volume of discharged ink droplets per unit time is made greater in making discharge detection than during the recording.

26. An ink discharge detecting method of an ink jet recording apparatus according to claim 24, wherein the discharge detection is made by judging a presence or absence of a detecting pattern recorded on part of a recording medium.

27. An ink discharge detecting method of an ink jet recording apparatus according to claim 24, wherein said recording head is an ink jet recording head for discharging the ink using heat energy, and said discharge detection is made by judging a difference between elevated temperatures of the recording head.

* * * * *

UNITED STATES PATENT AND TRADEMARK OFFICE

CERTIFICATE OF CORRECTION

PATENT NO. : 6,048,046
DATED : April 11, 2000
INVENTOR(S) : Atsushi Saito et al.

It is certified that error appears in the above-identified patent and that said Letters Patent is hereby corrected as shown below:

COVER PAGE:

Under Foreign Patent Documents, "59138461" should read --59-138461---, and "2187363" should read --2-187363--.

The Abstract should be replaced with the following:

--An ink jet recording system for recording using a recording head which discharges heated ink onto a recording medium through discharge ports includes temperature detection of ink discharged through the discharge ports, position of the recording head so that a temperature of ink discharged through the discharge ports can be detected, detection of discharge or non-discharge of ink based on the temperature detection, variation of discharge of ink droplets, and control of the variation during discharge detection.--

COLUMN 1:
Line 58, "undischarge" should read --nondischarge--.

COLUMN 2:
Line 5, "undis-" should read --nondis- --; and
Line 58, "undischarge" should read --nondischarge--.

COLUMN 3:
Line 4, "undischarge" should read --nondischarge--.

UNITED STATES PATENT AND TRADEMARK OFFICE

CERTIFICATE OF CORRECTION

PATENT NO. : 6,048,046
DATED : April 11, 2000
INVENTOR(S) : Atsushi Saito et al.

It is certified that error appears in the above-identified patent and that said Letters Patent is hereby corrected as shown below:

COLUMN 5:
Line 9, "the-recording" should read --the recording--.

COLUMN 7:
Line 18, "la" should read --1a--.

COLUMN 11:
Line 29, "the substantially same" should read --substantially the same--;and
Line 54, "hundreds" should read --hundreds of--.

COLUMN 12:
Line 66, "undischarge" should read --nondischarge--.

COLUMN 13:
Line 8, "one" should read --ones--; and
Lines 20 and 62, "can not" should read --cannot--.

COLUMN 14:
Line 5, "can not" should read --cannot--.

COLUMN 15:
Line 30, "more early" should read --earlier--.

COLUMN 16:
Line 18, the sentence beginning with "The CPU 23" should not begin a new paragraph, but should be part of the previous paragraph.

UNITED STATES PATENT AND TRADEMARK OFFICE

CERTIFICATE OF CORRECTION

PATENT NO. : 6,048,046
DATED : April 11, 2000
INVENTOR(S) : Atsushi Saito et al.

It is certified that error appears in the above-identified patent and that said Letters Patent is hereby corrected as shown below:

COLUMN 17:
Line 8, "above described," should read --described above,--.

COLUMN 19:
Lines 25 and 30, "are" should read --is--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*